US009272301B2

(12) United States Patent
Seccombe

(10) Patent No.: US 9,272,301 B2
(45) Date of Patent: Mar. 1, 2016

(54) APPARATUS AND METHOD FOR NON-CONTACT MANIPULATION, CONDITIONING, SHAPING AND DRYING OF SURFACES

(71) Applicant: S. Dana Seccombe, Foster City, CA (US)

(72) Inventor: S. Dana Seccombe, Foster City, CA (US)

( * ) Notice: Subject to any disclaimer, the term of this patent is extended or adjusted under 35 U.S.C. 154(b) by 22 days.

(21) Appl. No.: 13/782,910

(22) Filed: Mar. 1, 2013

(65) Prior Publication Data

US 2014/0245950 A1 Sep. 4, 2014

(51) Int. Cl.

| | |
|---|---|
| ***B41J 2/01*** | (2006.01) |
| ***B05C 5/02*** | (2006.01) |
| ***B41J 3/60*** | (2006.01) |
| ***B41J 11/00*** | (2006.01) |
| ***B41J 11/06*** | (2006.01) |

(52) U.S. Cl.

CPC ..... *B05C 5/0208* (2013.01); *B41J 3/60* (2013.01); *B41J 11/002* (2013.01); *B41J 11/0085* (2013.01); *B41J 11/06* (2013.01)

(58) Field of Classification Search

CPC ..... B65H 5/22; B41J 11/004

See application file for complete search history.

(56) References Cited

U.S. PATENT DOCUMENTS

| | | | | |
|---|---|---|---|---|
| 4,272,771 A | | 6/1981 | Furukawa | |
| 4,422,988 A | * | 12/1983 | Kornylak | 264/40.3 |
| 5,376,958 A | | 12/1994 | Richtsmeier et al. | |
| 5,428,375 A | | 6/1995 | Simon et al. | |
| 5,456,539 A | | 10/1995 | Wright et al. | |
| 5,459,498 A | | 10/1995 | Seccombe et al. | |
| 5,541,629 A | | 7/1996 | Saunders et al. | |

(Continued)

FOREIGN PATENT DOCUMENTS

| | | |
|---|---|---|
| DE | 202005005878 U1 | 6/2005 |
| DE | 102006032377 A1 | 1/2008 |

(Continued)

OTHER PUBLICATIONS

JP OA Translation, Application No. JP 2007-525057, Dated Mar. 9, 2011.

(Continued)

*Primary Examiner* — Shelby Fidler
*Assistant Examiner* — Tracey McMillion
(74) *Attorney, Agent, or Firm* — Allston L. Jones; Peters Verny, LLP

(57) ABSTRACT

Non-contact method and apparatus for Drying, Conditioning, Shaping and Manipulating of sheet fed Media. These functions are performed either on one side, or simultaneously or delayed one from the other on both sides, of the Media. For Drying, the energy applied is minimized to that necessary to supply latent heat of vaporization permitting use in, for example, low cost printers. No friction is introduced in the transport path enabling high speed, reliable Media transport. A region is established between Media and Platen wherein heat, support, and chemical or other processing may occur in a controlled way. Relatively few, inexpensive, and small parts are needed lowering the cost, energy, and space requirements for performing the various functions allowing for new applications in many fields. Media is supported a specific distance from a Platen by a balance of Fluid forces. The Media and the Platen bound a region in which forced convection greatly enhances process rates otherwise be limited by diffusion. The method and apparatus described is particularly suitable for high speed, low cost, inkjet printing.

22 Claims, 14 Drawing Sheets

(56) References Cited

U.S. PATENT DOCUMENTS

| | | | |
|---|---|---|---|
| 5,631,685 | A | 5/1997 | Gooray et al. |
| 5,650,811 | A | 7/1997 | Seccombe et al. |
| 5,657,061 | A | 8/1997 | Seccombe et al. |
| 5,688,057 | A | 11/1997 | Wright et al. |
| 5,726,772 | A | 3/1998 | Parker et al. |
| 5,808,655 | A | 9/1998 | Haas et al. |
| 5,812,155 | A | 9/1998 | Seccombe |
| 5,864,349 | A | 1/1999 | Hirabayashi et al. |
| 5,980,028 | A | 11/1999 | Seccombe |
| 6,020,976 | A | 2/2000 | Fujita et al. |
| 6,025,928 | A | 2/2000 | Takemura et al. |
| 6,033,048 | A | 3/2000 | Nicoloff, Jr. et al. |
| 6,033,064 | A | 3/2000 | Pawlowski, Jr. et al. |
| 6,057,933 | A | 5/2000 | Hudson et al. |
| 6,082,849 | A | 7/2000 | Chang et al. |
| 6,095,637 | A | 8/2000 | Hirabayashi et al. |
| 6,099,108 | A | 8/2000 | Weber et al. |
| 6,155,670 | A | 12/2000 | Weber et al. |
| 6,193,347 | B1 | 2/2001 | Askeland et al. |
| 6,257,714 | B1 | 7/2001 | Seccombe |
| 6,304,333 | B1 | 10/2001 | Shaked et al. |
| 6,331,053 | B1 | 12/2001 | Seccombe et al. |
| 6,354,694 | B1 | 3/2002 | Weber et al. |
| 6,357,847 | B1 | 3/2002 | Ellson et al. |
| 6,364,471 | B1 | 4/2002 | Seccombe |
| 6,409,299 | B1 | 6/2002 | Aihara |
| 6,460,969 | B1 | 10/2002 | Pinkernell |
| 6,471,332 | B1 | 10/2002 | Vilanova et al. |
| 6,499,838 | B2 | 12/2002 | Seccombe et al. |
| 6,543,871 | B1 | 4/2003 | Rosen et al. |
| 6,578,959 | B1 | 6/2003 | Seccombe |
| 6,588,877 | B2 | 7/2003 | Sloan, Jr. et al. |
| 6,623,106 | B2 | 9/2003 | Silverbrook |
| 6,980,328 | B2 | 12/2005 | Hudson |
| 2003/0007165 | A1 | 1/2003 | Hudson |
| 2004/0046831 | A1 | 3/2004 | Hempel |
| 2004/0079248 | A1 | 4/2004 | Mayer et al. |
| 2004/0145624 | A1 | 7/2004 | Wouters |
| 2006/0054774 | A1 | 3/2006 | Yassour et al. |
| 2008/0145190 | A1* | 6/2008 | Yassour et al. ..... 414/147 |
| 2010/0157006 | A1* | 6/2010 | Kanada et al. ..... 347/102 |
| 2011/0023757 | A1* | 2/2011 | Richman et al. ..... 108/50.13 |

FOREIGN PATENT DOCUMENTS

| | | | |
|---|---|---|---|
| EP | 0724965 | A2 | 8/1996 |
| EP | 0822511 | A2 | 2/1998 |
| EP | 0916915 | A1 | 5/1999 |
| EP | 0968832 | A1 | 1/2000 |
| EP | 1190862 | A1 | 3/2002 |
| GB | 668741 | A | 3/1952 |
| JP | 05-057965 | A | 3/1993 |
| JP | 08-197802 | A | 8/1996 |
| JP | 10-044519 | A | 2/1998 |
| JP | 2002-036515 | A | 2/2002 |
| JP | 2003-284434 | A | 10/2003 |
| JP | 2004-122546 | A | 4/2004 |

OTHER PUBLICATIONS

EESR, Application No. EP05786801, Dated Nov. 28, 2013.
EESR, Application No. EP14156505, Dated Jun. 6, 2014.
Hewlett Packard Journal, Feb. 1994, vol. 45, Issue 1.

* cited by examiner

Alternative Design Parameters and Resultant Size, separation (t) and Power

| Design | Tin | Ppos | Tpap init | Cqp | rm | lp | b | rp | rn | ln | t wall | Nusselt | Reynolds | $\eta_{heat\ exchange}$ | A | Length | t | M | Pow-air | Pow-pap | Power |
|---|---|---|---|---|---|---|---|---|---|---|---|---|---|---|---|---|---|---|---|---|---|
| | deg C | In. H20 | deg C | | mils | mils | mils | mils | mils | mils | mils | | | | sq inch | inch | mils | lit-sec | watts | watts | watts |
| 1 | 20 | 0.28 | 20 | 0.5 | 36.6 | 300 | 104.5 | 52 | 38.1 | 60 | 14 | 6.9 | 2043 | 0.85 | 48.1 | 5.5 | 5 | 19.3 | 0 | 0 | 0 |
| 2 | 20 | 0.14 | 20 | 0.5 | 102 | 300 | 295.3 | 160 | 105 | 60 | 14 | 13 | 5877 | 0.67 | 51.3 | 5.8 | 16 | 22.9 | 0 | 0 | 0 |
| 3 | 20 | 0.14 | 20 | 0.5 | 60 | 200 | 198.4 | 120 | 67.3 | 60 | 14 | 8.8 | 3209 | 0.89 | 67.3 | 7.6 | 8.1 | 18.8 | 0 | 0 | 0 |
| 4 | 20 | 0.14 | 20 | 0.5 | 60.8 | 300 | 198.4 | 120 | 67.3 | 60 | 14 | 8.8 | 3209 | 0.89 | 67.3 | 7.6 | 8.1 | 18.8 | 0 | 0 | 0 |
| 5 | 20 | 0.14 | 20 | 0.5 | 67.5 | 300 | 217.4 | 130 | 79.1 | 60 | 14 | 9.8 | 3963 | 0.95 | 68.9 | 7.8 | 7.3 | 18 | 0 | 0 | 0 |
| 6 | 20 | 0.14 | 20 | 0.5 | 78.1 | 300 | 237.4 | 120 | 92.3 | 60 | 14 | 10 | 4200 | 0.95 | 72.1 | 8.2 | 7.8 | 18 | 0 | 0 | 0 |
| 7 | 20 | 0.14 | 20 | 0.7 | 69.7 | 300 | 217.4 | 130 | 79.1 | 60 | 14 | 9.5 | 3757 | 0.95 | 72.1 | 8.2 | 7.4 | 18 | 0 | 0 | 0 |
| 8 | 20 | 0.14 | 20 | 0.5 | 37.4 | 300 | 104.5 | 52 | 38.1 | 60 | 14 | 5.2 | 1255 | 0.85 | 72.1 | 8.2 | 5.4 | 19.3 | 0 | 0 | 0 |
| 9 | 20 | 0.14 | 20 | 0.5 | 74.8 | 100 | 263.3 | 150 | 89.1 | 60 | 14 | 10 | 4304 | 0.93 | 75.3 | 8.6 | 9.2 | 18.3 | 0 | 0 | 0 |
| 10 | 20 | 0.14 | 20 | 0.7 | 48.5 | 400 | 163.5 | 85 | 55.9 | 60 | 14 | 6 | 1660 | 0.95 | 105.8 | 12.0 | 6.4 | 18 | 0 | 0 | 0 |
| 11 | 20 | 0.14 | 20 | 0.5 | 31.5 | 100 | 114.1 | 58 | 39.1 | 60 | 14 | 4.7 | 1046 | 0.94 | 105.8 | 12.0 | 5 | 18.1 | 0 | 0 | 0 |
| 12 | 20 | 0.14 | 20 | 0.7 | 32.7 | 100 | 114.1 | 58 | 39.1 | 60 | 14 | 4.6 | 1015 | 0.94 | 107.4 | 12.2 | 5 | 18.1 | 0 | 0 | 0 |
| 13 | 20 | 0.14 | 20 | 0.7 | 28.1 | 200 | 91.6 | 47 | 31.4 | 60 | 14 | 3.9 | 741 | 0.94 | 112.2 | 12.7 | 4.3 | 18.1 | 0 | 0 | 0 |
| 14 | 20 | 0.14 | 20 | 0.7 | 53.7 | 400 | 217.4 | 110 | 63.1 | 60 | 24 | 6.2 | 1777 | 0.95 | 133.0 | 15.1 | 8.4 | 18 | 0 | 0 | 0 |
| 15 | 20 | 0.14 | 20 | 1 | 28.1 | 400 | 103.7 | 60 | 26.2 | 60 | 14 | 3.4 | 586 | 0.89 | 141.0 | 16.0 | 5.7 | 18.8 | 0 | 0 | 0 |
| 16 | 20 | 0.14 | 20 | 0.7 | 29 | 200 | 123.6 | 69 | 31.1 | 60 | 14 | 3.9 | 737 | 0.9 | 141.0 | 16.0 | 6.4 | 18.7 | 0 | 0 | 0 |
| 17 | 20 | 0.14 | 20 | 0.7 | 29.6 | 200 | 125.1 | 68 | 32.4 | 60 | 24 | 3.9 | 758 | 0.91 | 142.6 | 16.2 | 6.3 | 18.5 | 0 | 0 | 0 |
| 18 | 20 | 0.14 | 20 | 0.7 | 28.3 | 100 | 125.1 | 68 | 32.4 | 60 | 24 | 3.9 | 758 | 0.91 | 142.6 | 16.2 | 6.3 | 18.5 | 0 | 0 | 0 |
| 19 | 20 | 0.14 | 20 | 1 | 20.9 | 400 | 67.1 | 26 | 15.7 | 60 | 24 | 2.2 | 250 | 0.67 | 153.8 | 17.5 | 6.3 | 22.9 | 0 | 0 | 0 |
| 20 | 20 | 0.14 | 23 | 0.5 | 37.4 | 300 | 104.5 | 52 | 38.1 | 60 | 14 | 5.2 | 1255 | 0.85 | 67.3 | 7.6 | 5.4 | 18.1 | 0 | 14.9 | 14.9 |
| 21 | 20 | 0.14 | 27 | 0.5 | 37.4 | 300 | 104.5 | 52 | 38.1 | 60 | 14 | 5.2 | 1255 | 0.85 | 60.9 | 6.9 | 5.4 | 16.4 | 0 | 34.8 | 34.8 |
| 22 | 20 | 0.14 | 35 | 0.5 | 37.4 | 300 | 104.5 | 52 | 38.1 | 60 | 14 | 5.2 | 1255 | 0.85 | 49.7 | 5.6 | 5.4 | 13.1 | 0 | 74.5 | 74.5 |
| 23 | 24 | 0.14 | 20 | 0.5 | 37.4 | 300 | 104.5 | 52 | 38.1 | 60 | 14 | 5.2 | 1255 | 0.85 | 62.5 | 7.1 | 5.4 | 16.5 | 76.9 | 0 | 76.9 |
| 24 | 27 | 0.28 | 20 | 0.5 | 36.6 | 300 | 104.5 | 52 | 38.1 | 60 | 14 | 6.9 | 2043 | 0.85 | 36.9 | 4.2 | 5 | 14.8 | 121.1 | 0 | 121.1 |
| 25 | 27 | 0.14 | 20 | 0.5 | 37.4 | 300 | 104.5 | 52 | 38.1 | 60 | 14 | 5.2 | 1255 | 0.85 | 56.1 | 6.4 | 5.4 | 14.8 | 121.1 | 0 | 121.1 |

*Figure 12*

APPARATUS AND METHOD FOR NON-CONTACT MANIPULATION, CONDITIONING, SHAPING AND DRYING OF SURFACES

BACKGROUND OF THE ART

1. Field of the Art

Manipulating, drying, conditioning or shaping continuous or cut sheet surfaces and surfaces of irregularly shaped objects. Examples include drying, curing, treating, plating, coating, etching, polishing and chemical polishing operations. Though specifically applicable to inkjet printing, the techniques are applicable in almost any surface drying, conditioning, manipulating and shaping situation of various materials that benefits from any of: high efficiency, uniformity, low cost, non-contact manipulation and, or conditioning, and controlled and uniform thicknesses. The techniques are especially useful in increasing the rates of diffusion limited processes at surfaces.

2. Description of the Related Art

Processes today are often limited by the speed at which they condition a surface or medium, which processes often require that the conditioned side not be touched.

In one example application, plating baths currently require close, uniform electrode spacing, high diffusion rates of reactants to the surfaces, and good temperature control. Typical existing plating baths incorporate large tanks which must maintain adequate stirring to maintain uniformity of reactants, but chemicals are wasted because very little of the reactants are actually adjacent the substrates, and energy is wasted due to large electrode spacing and bath heating requirements. In another application, in low cost inkjet printers, the printer mechanism waits for ink to dry or cure sufficiently on a previously printed sheet before adding the next sheet to the output stack to avoid smearing of the ink on the previously printed sheet. Typically low cost printers just wait until the ink dries on the previously printed sheet, even though the print mechanism is capable of printing much faster. Printers which print both sides of the page typically wait even longer for the first printed side to dry before the paper is put through a reverser so the second side can be printed since the reverser mechanism tends to smear the ink on the first side if the ink is not dry. Thus printers that print on both sides of the paper print far slower than printers that only print on one side of the paper. Drying and solidification of inks is limited by the slow diffusion rates of solvents away from the media, and also by slow rate of diffusion of the required heat of vaporization from room temperature air to the evaporatively cooled media.

Higher cost/price printers add various heating mechanisms, including heated platens (sometimes with vacuum hold downs to increase heat transfer rates) and radiant heating means with very little of the radiant heat actually being absorbed by the ink. To date, these methods have been costly, bulky, and inefficient, prohibiting their use in small, low cost applications, such as small office and home printing.

Many prior art drying/fixing/conditioning methods include, individually or in combination, one or more of the following:

1. Drying with a jet of air while the media is suspended between two rollers;
2. Heating the media by means of contact with a hot platen;
3. Heating the media through some form of radiation (typically microwave or infrared); or
4. Introducing, via spray or vapor, fixative materials or catalysts that immobilize or otherwise treat the surface of the media and materials adsorbed thereto.

However, all prior art methods have one or more of the following limitations:

1. The apparatus used to manipulate the media cannot support the media without contacting at least one side of the media;
2. The system requires the use of continuous media;
3. In drying, considerable heat is wasted because the media does not absorb a substantial portion of the heat used;
4. Friction is introduced into the media path which hinders, or renders unreliable, the media transport process, at high speeds;
5. The dryer/conditioner apparatus is inherently complicated and therefore expensive and unreliable;
6. The drying fluid flow disturbs other processes. For example, in inkjet printing, ink droplets are deflected from their intended target on the media;
7. The apparatus encloses the media, and is therefore bulky;
8. Drying/conditioning is a compromise between what is desired, and what is possible, requiring changes in other parts of a system to accommodate such deficiencies. For example, in inkjet printers, generally inks are carefully designed to dry as fast as possible because the drying apparatus is marginal, and therefore the ink composition often includes surfactants which imply a trade-off between the ink composition required to produce fast drying and that required to produce sharp edge acuity and vibrant color of the image;
9. Prior art systems still have to wait for drying/conditioning despite the improvements that have been made;
10. It is not possible, or it is expensive, to recycle used materials or heat; or
11. The apparatus shape cannot be configured to accomplish, simultaneously, other functions in addition to drying/conditioning, such as flattening the media, or transporting and reorienting, or warehousing the media.

Low cost printers are capable of depositing ink completely covering a page at about a 30 page per minute rate. However, they never actually print at that rate because the ink takes at least 10 seconds to dry adequately before a successive page can be stacked upon the previously printed page. Inkjet printer manufacturers have been unable to make inks that do all of the following:

1. Dry more rapidly than about 10 seconds on the printed page without the use of expensive, power intensive, and bulky driers, or volatile solvents;
2. Have sharp edge acuity when printed;
3. Have dark blacks and vibrant colors; and yet
4. Do not dry out, and clog nozzles of the printhead when the printer is not in use.

Typical inks are made with a water carrier, which is environmentally safe, and whose chemistry with respect to pigments and dyes is well understood. The inks further contain surfactants to help the ink penetrate into the paper, humectants to keep the ink moist in the printhead, dyes or pigments for color, and pigments for black. There are often deliberate chemical interactions between the inks to keep one ink from bleeding into another on the paper. A worst case blacked out page at 600 dots per inch of 5 picoliter black dots has about 0.16 cc of ink on the page. The water in the ink sinks into the paper in about 5 seconds, and begins to swell the paper fibers about 1 percent, causing the paper to bow toward the side with ink on it, causing what is known as wet cockle. If the ink is deposited in a swath of a width W, surrounded by dry paper, the paper buckles in a bubble shape about diameter W, and height of about 0.1 W, after, typically, 20 seconds. As the water further penetrates the page, the backside of the paper also begins to swell, tending to flatten, then reverse the direction of the bubbles as the front side dries somewhat, and the back side is being penetrated by water. Eventually the paper is uniformly swelled within the wet swath, and buckles alternating positively and negatively along the swath length, i.e., the width of the paper. As the water in the paper becomes uniformly distributed, and then evaporates, in a minute or more, the fibers tend to return to their former length, but the paper fiber bonds have yielded, and the paper does not return to a completely flat shape leaving residual dry cockle.

Wet cockle can cause a head crash, where the paper buckles enough to hit the scanning printhead, often located about 60 mils above the paper surface. Limiting the size of the swath, and the amount of ink put on the page, can minimize the height of wet cockle, but smaller swaths result in lower print speeds, and less ink results in less dark blacks or less vibrant colors.

Dry cockle is evident in unsightly wrinkled pages and is to be avoided.

Generally the black ink pigment is intended to stay on top of the paper to produce the darkest blacks, with optical densities of 1.3 to 1.4, comparable to offset printed inks. Black pigment inks cannot contain surfactants to the extent that the pigment wicks across fibers, since that would result in jagged edges on letters which is highly undesirable. Thus the black ink pigment is susceptible to smearing, since it is on the paper surface and mechanically in contact with the next sheet of paper which will be stacked on top of it. Though pigments tend to coalesce and solidify when the water carrier is drawn into the paper (after at least 5 seconds), the pigment is often comprised of block copolymers similar to latex paint, thus pigments do not become permanent for days.

Color inks are typically dyes in water solutions with surfactants which help the water penetrate the paper more rapidly. Color inks take less water to cover a region than black inks because the surfactant spread the ink, and because the color inks do not have to be as dense as black is for text. Since the human eye is not as sensitive to color, jagged edges on color droplets are less objectionable. However, color inks would be more vibrant if they were on the surface. One approach would be to use color pigments but pigments typically are ground up solids with particle sizes over 0.1 micron and therefore scatter all colors to some extent making them somewhat duller than dyes that are confined to the surface.

Thus both black pigments and color dyes benefit by being dried rapidly before they can penetrate the surface of the paper. And, problems of paper cockle would also be relieved if paper could be dried substantially in less than 5 seconds (less than 2 seconds for a 30 page per minute printer).

This problem of drying at greater than 30 pages per minute has been continually studied, and to date has not been effectively solved in a way that is suitable for small (less than 1 cubic foot), low cost (less than $100), printers or even printers that are 5 times as large, and 5 times as costly, and ⅕ the speed.

Some ineffective solutions in the prior art include:

U.S. Pat. No. 6,305,796 by Szlucha et al., which discloses an enclosure wherein paper is heated with radiant heat from infra-red bulbs within a reflective enclosure. The enclosure itself is a substantial part of a cubic foot in dimension, the heat required is substantially more than 180 watts due to bulb and absorption inefficiencies, and the paper drying time is longer than the 2 seconds required at a printing rate of 30 pages per minute.

U.S. Pat. No. 6,463,674 by Meyers et al, which discloses an air impingement drying system that also fully encloses the paper, and, because of the large air boundary layer inherent in the geometry, Meyers system is inadequate to meet conditions stated above in the discussion of the Szlucha patent and only slowly dries the paper.

U.S. Pat. No. 6,382,850 by Freund et al., which discloses a large, complex system of heaters and air knives disposed along a 10 inch linear vacuum belt with the paper being held by the back side. In the Freund system the paper is moved at 5 cm per second, therefore drying at only a 12 pages per minute rate.

U.S. Pat. No. 5,510,822 by Vincent et al., which discloses a heated platen which physically contacts the backside of the paper, and the paper is held in close contact to the platen by a vacuum which is only released to allow the paper to move. This has a high enough heat transfer rate, but would require, at a 30 pages per minute printing rate, that the vacuum hold down pressure be released and restored at least 4 times per second (for a 1 inch swath print mechanism), and it has no provision for adequate air movement to dry the ink.

None of the above are suited to simultaneous double sided printing since they all hold one side of the paper in the drying process.

SUMMARY OF THE INVENTION

That which is disclosed here enables low cost, compact, non-contacting, low energy usage means and apparatus for drying/conditioning/shaping/manipulating media, including media that is being dried/conditioned on both sides, without the disadvantages outlined above.

The purpose of the present invention is to support a medium, with applied material on or within it at a fixed distance from a platen by action of fluid flow. The region between the platen and the medium is available for reactions that may be carried out in, or with the aid of the fluid. The configuration enables high surface tangential rates of flow, thus decreasing boundary layer thicknesses, and accelerating diffusion limited processes at the media-fluid interface. By confining the fluid to a small region, with high local velocities, much higher reaction rates occur in a much smaller geometry.

One disclosed preferred embodiment includes a platen which is supplied with both positive and negative pressure which propels fluid through orifices which said orifices are configured to hold the media a predetermined height above the platen, by appropriate fluid flows and consequent forces. The platen surface shape can be flat, ruled, or any arbitrary shape. The platen itself may be rigid or flexible. The media may be heated directly with heated fluid which supplies part of the media suspension means, or alternatively, with heaters thermally coupled to the platen or by radiation whose source is incorporated in the platen, or the media may be heated prior to entry into the region adjacent the platen. The media may be exposed to radiation, catalysts, or reactants. The suspension of the media by action of the fluid a small, fixed, distance above the platen eliminates friction, and enables efficient and predictable energy transfer and, or, application of reactive chemicals, in a very thin, and therefore easily controlled reaction region.

BRIEF DESCRIPTION OF THE DRAWINGS

FIG. 12 is a table of alternative design parameters enabling drying of blacked out pages printed by a 600 dpi, 5 picoliter drop, inkjet printer at 30 pages per minute.

DETAILED DESCRIPTION OF THE INVENTION

Figure 1:
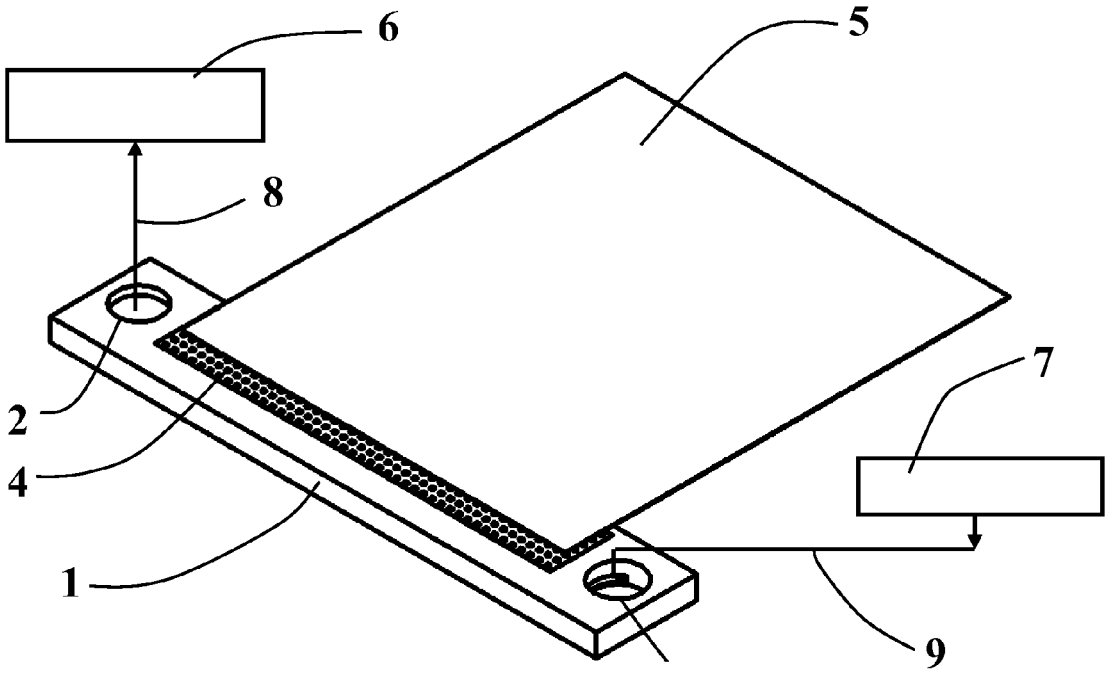
FIG. 1 is a perspective view of a Platen with a sheet of Media partially advanced across the Platen with positive and negative pressure sources coupled to the Platen and the Platen having Positive and Negative Pressure Orifices that are substantially the same size as each other.

Though the concepts described below are specifically applicable to inkjet printers, they are also applicable to other processes involving drying and/or conditioning and/or manipulating and/or shaping of various media, including those that are more or less flexible than paper. These concepts are especially applicable where one or more processes that are diffusion limited occur at a surface.

One object of the designs of the disclosure is to dry or condition a medium which may have Applied Material distributed throughout, or have Applied Material on one or both sides.

Units and Terms Used in the Description

In this document, all units are SI units, unless otherwise designated and temperatures are in degrees Centigrade.

In this document, the following definitions are used:

Media:
- the substrate upon which an Applied Material has been deposited (in the case of an inkjet printer, the Media is often paper), or a surface which itself is to be Conditioned, Manipulated, Dried, polished, etched, or shaped.

Fluid:
- the material which hydraulically supports the Media; in a Dryer/Conditioner for an inkjet printer, this Fluid is air; optionally, Fluids may be heated, or contain Reactants; Fluids can be liquids or gases.

Surrounding Fluid:
- is material which surrounds the apparatus, and may or may not be of the same composition as the Fluid. In an inkjet printer, this would be environmental air. In a plating solution, this could be a chemical bath which may, or may not have the same composition as the Fluid.

Applied Material:
- material to be Dried or Conditioned, which is previously deposited on, or may be disbursed throughout, the Media, before the Media enters the region of the Platen. (In an inkjet printer, the Applied Material is ink and ink solvents).

Additional Applied Material:
- material deposited or applied via the Fluid to the Media within the Platen region, through Orifices which may be individually actuated. Additional Applied Material may be of the same or different composition of the Applied Material; this material may be permanently deposited, or act as a catalyst or reagent.

Platen:
- the surface which is proximate the Media being Dried/Conditioned/Manipulated/Shaped; Platen has Positive and Negative Pressure Orifices therethrough.

Orifice:
- a hole in the Platen which is hydraulically connected to a Fluid pressure source; typically, round, but may be other shapes.

Positive Pressure Orifice:
- Orifice supplied with positive pressure relative to ambient pressure.

Negative Pressure Orifice:
- Orifice supplied with negative pressure, or in some cases, zero (0) pressure relative to ambient pressure.

Reactants:
- chemicals that are transported through the Platen to the Media, by way of the Fluid;

Dried and Dry:
- removing a volatile fraction of the Applied Material;

Conditioned, Conditioning, and Condition:
- altering the chemical or physical, electrical, or magnetic properties of the Applied Material, Additional Applied Material or the Media through a chemical, thermal, electrical or magnetic process, or other processes; examples including cross-linking polymers, crystallization; coating and plating, etching and chemically polishing; catalyzing, polarizing and charging.

Shaping:

altering the surface geometry of the Media either temporarily, for instance, to provide temporary stiffening of the Media, or permanently, to create or remove wrinkles, or establish a particular geometry.

Protected Zone:

a region not to be disturbed by Fluid flow.

Dryer or Conditioner:

device which dries or Conditions the Media or Applied Material on or in the Media.

Plenum:

a duct fluidically connected to a pressure source such as a fan or compressor, and is designed, when operating, to provide a minimal pressure difference between the pressure source and any region connected to said source via said duct.

Manifold:

Elongated tube that fluidically connects a Plenum to an Orifice and may have a pressure drop under high flow conditions.

Manipulating:

Transporting, bending, and or rotating a medium.

FIG. 1 is a perspective view of a housing 1 that incorporates a Platen 4 that is nearly as long and wide as housing 1 with housing 1 having negative pressure port 2 at one end and positive pressure port 3 at the other end. Though shown at the ends, pressure ports may be disposed as determined by the other physical constraints of the housing that it is embedded in, and by the objective of keeping the pressure in the Plenums uniform. Coupled to the respective pressure ports there is a negative pressure source 6 and a positive pressure source 7 via conduits 8 and 9, respectively. Additionally, Media 5 is shown partially advanced (right to left) across Platen 4 having Positive and Negative Pressure Orifices that are substantially the same size as each other. In this configuration, the bottom side of Media 5 is the side that was processed, plated, printed, etc. before being advanced to Platen 4. The mechanism for advancing Media 5 and for processing the bottom side of Media 5 is discussed in more detail in conjunction with FIGS. 8*a* and 8*b*.

Negative pressure is provided to the Fluid by negative pressure source 6 which is connected to housing 1 by conduit 8 to draw Fluid through Negative Pressure Orifices Platen 4 from beneath Media 5. Negative pressure source 6 may contain a fan, pump, or blower to exhaust Fluid, for example air, to create a partial vacuum on conduit 8, and may optionally contain collection vessels to capture any materials in the recovered Fluid that enters the Negative Pressure Orifices in Platen 4. The negative pressure supplied by the fan, blower or other pressure apparatus may be constant or pulsed.

Conduit 8 may be as long as convenient, subject to being sized so no substantial pressure drop occurs along its length. Alternatively, negative pressure source 6 can be mounted directly on housing 1, and fluidically connected to it.

Similarly, positive pressurized Fluid is supplied from positive pressure source 7 which may imbue the Fluid with Additional Applied Material, and/or Reactants, or heat the Fluid. Positive pressure source 7 may contain a fan, pump, or blower, and may optionally contain apparatus to introduce Reactants or Additional Applied Materials into the Fluid. Positive pressure source 7 may be a pulsed source to increase heat or material transfer rates and/or may optionally contain a heater to heat the Fluid. Such devices are commonly available in many combinations and configurations. The Reactants and additional Applied Material may be liquids, solids (particles), or gasses, or combinations.

Conduit 9 transports the Fluid from positive pressure source 7 to positive pressure port 3 with conduit 9 being as long as convenient, subject to being sized so no substantial pressure drop occurs along its length. Alternatively, positive pressure source 7 can be mounted directly on housing 1, and fluidically connected to it.

Housing 1, in addition to providing support for Platen 4, encases Fluid paths therewithin coupled to the respective one of the negative and positive pressure ports 2 and 3 and corresponding Positive and Negative Pressure Orifices in Platen 4 as will become clear in the discussion of FIGS. 2*a-e*.

The Orifices shown in Platen 4 permit the passage of Fluids, for instance air, and are interspersed so that the Positive Pressure Orifices, supplied with Fluid under positive pressure tends to distance Media 5 from Platen 4 while the Negative Pressure Orifices supplied with negative pressure, tend to attract Media 5 closer to Platen 4. A balance of forces is achieved at a specific distance of Media 5 from Platen 4, with Media 5 remaining at a specific designed distance from Platen 4 (i.e., at an equilibrium point), as determined by the relative size, geometry, and disposition of the Positive and Negative Pressure Orifices, the pressures supplied, and the pressure head losses in the Manifolds (not shown) between the corresponding negative and positive pressure ports 2 and 3 supplying the corresponding Negative and Positive Pressure Orifices.

Since Media 5 is supported above Platen 4 by the Fluid from the various Pressure Orifices, there is little friction between Media 5 and Platen 4, and thus there is no smearing of the Applied Material which may be on the side of Media 5 adjacent Platen 4. The action of the Fluid, with design parameters to be discussed below, holds Media 5 at an equilibrium distance spaced away from Platen 4. The Fluid forces are substantially greater than gravitational forces, therefore allowing alternative configurations of Platen 4, such as with Platen 4 above Media 5, with the Applied Material on Media 5 facing Platen 4, or in a configuration where the Media is fed vertically.

Figure 2A:
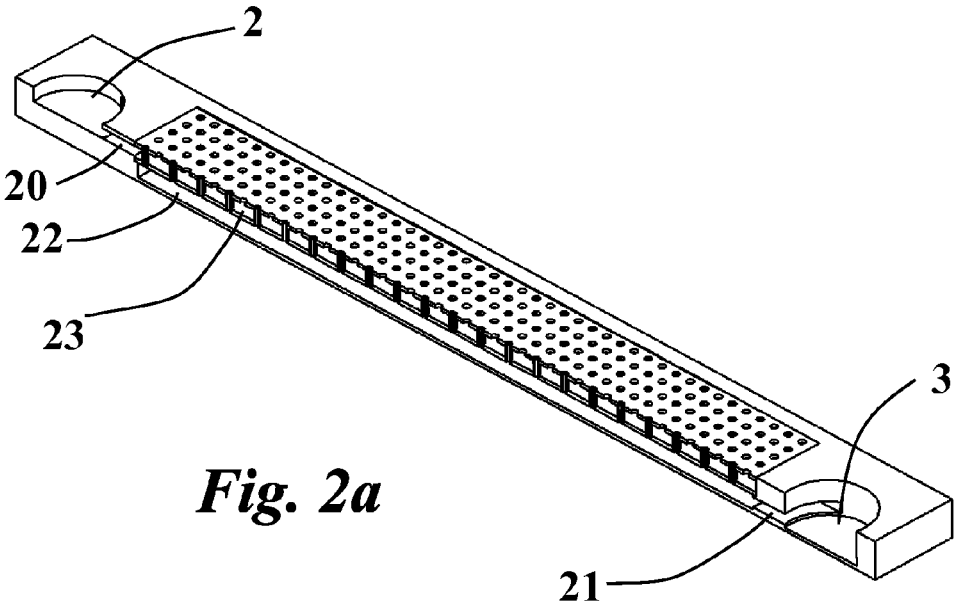
FIGS. 2*a*-2*e* are perspective views of the housing and Platen of FIG. 1 that illustrate additional details.

FIG. 2*a* is an enlarged lengthwise perspective vertical cross-sectioned view of housing 1 and Platen 4 of FIG. 1 showing positive pressure port 3 coupled to internal positive pressure Plenum 22 via passage 21 and negative pressure port 2 coupled to internal negative pressure Plenum 23 via passage 20. In this view it can be seen that positive Plenum 22 is on the bottom and negative pressure Plenum 23 is directly above it, with both beneath Platen 4.

Figure 2B:
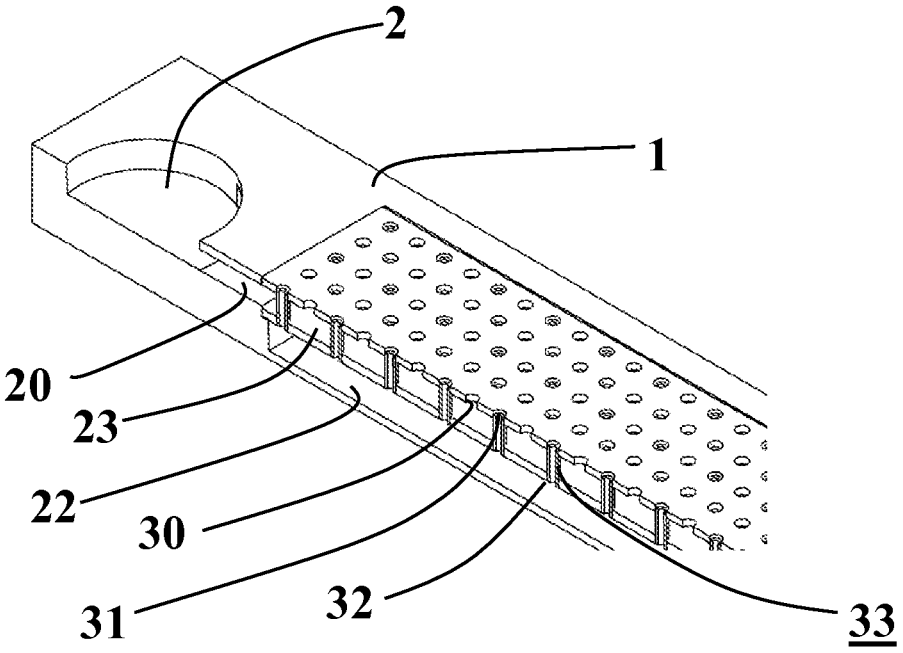

FIG. 2*b* is an enlarge left end view of the perspective vertical cross-sectioned view of housing 1 and Platen 4 of FIG. 2*a* showing in greater detail the internal positive and negative pressure Plenums 22 and 23, respectively. Negative pressure port 2 is connected to negative pressure Plenum 23 via passage 20 which is in communication with alternating Negative Pressure Orifices 30 in Platen 4. Also shown is positive pressure Plenum 22 in communication with Manifold 33 that consists of spaced apart tubes 32 or openings that pass through negative Plenum 23 with tubes 32 opening through Positive Pressure Orifices 31 in Platen 4. Positive and Negative Pressure Orifices 31 and 30 are each shown staggered back and forth by one position in alternating rows of the corresponding Orifices in Platen 4 so each Orifice of either type is surrounded by a spaced apart equal number of Orifices of the same and opposite type except at the edge of Platen 4 where they alternate. Stated another way, each Positive Pressure Orifice 31 is surrounded by four Negative Pressure Orifices 30, and each Negative Pressure Orifice 30 is surrounded by four Positive Pressure Orifices 31, to make alternating regions of negative and positive pressure above Platen 4. Though shown in this configuration, other orifice arrangements are possible so long as they result in alternating regions of positive and negative pressure, and said Orifices are sized so that, together with the Fluid resistance characteristics of Manifold 33 the desired equilibrium separation is achieved.

Figure 2C:
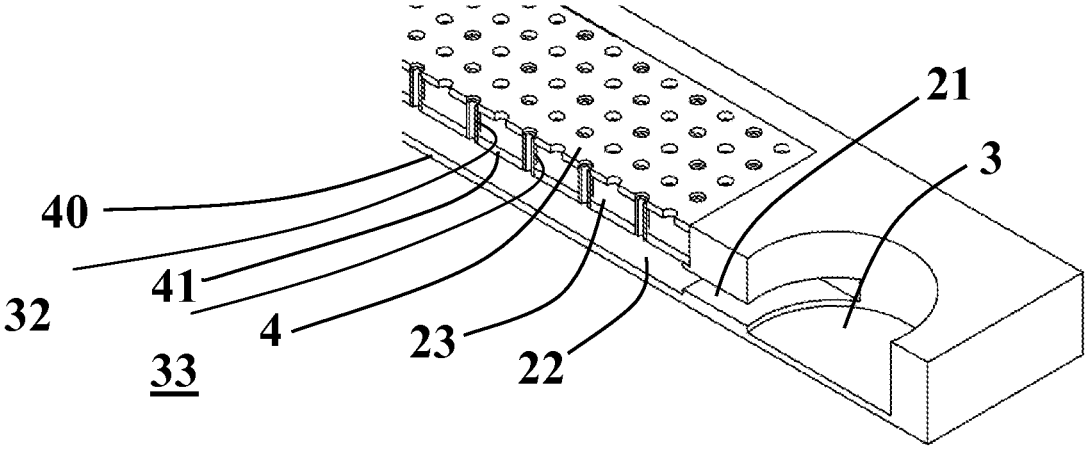

FIG. 2*c* is an enlarge right end view of the perspective vertical cross-sectioned view of housing 1 and Platen 4 of FIG. 2*a* showing in greater detail internal positive and negative pressure Plenums 22 and 23, with the positive pressure port 3 connected to the positive pressure Plenum 22 through passage 21 and individual tubes 32 of Manifold 33. Also shown is lower wall 40 of positive Plenum 22 as well as upper wall 41 of positive Plenum 22. Upper wall 41 is penetrated by Fluid under positive pressure into tubes 32 of Manifold 33. Though shown with the positive Plenum on the bottom, and a negative Plenum closer to the Platen, the locations of Plenums, and which one is connected to a Manifold, could be reversed, as long as other elements of the design allow maintenance of the desired Media 5 to Platen 4 separation.

Figure 2D:
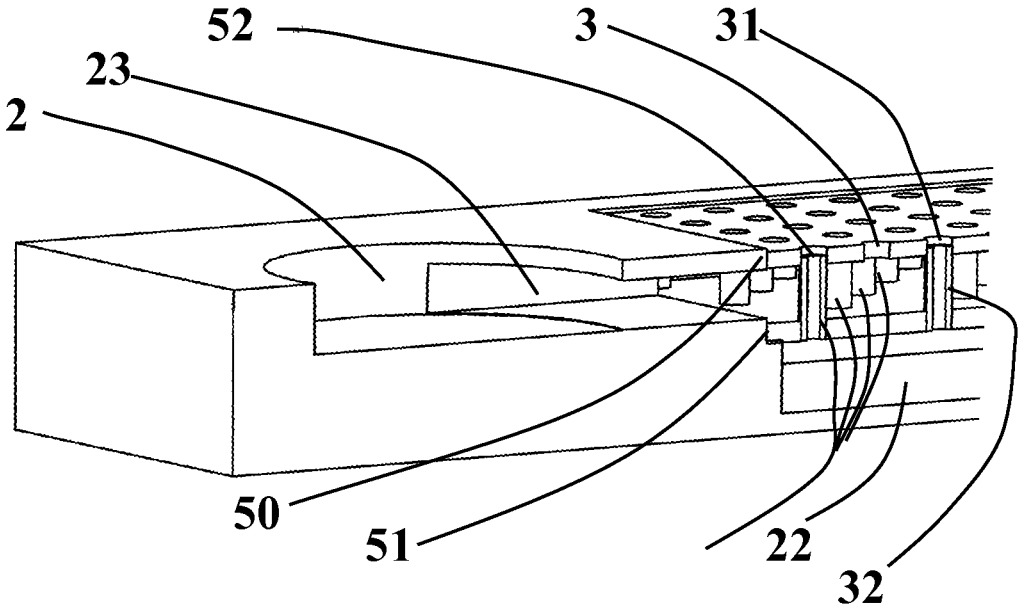

FIG. 2*d* is a different perspective view of the vertical cross-sectioned view of Platen 4 of FIG. 2*b* of negative pressure port 2 end showing in greater detail the internal positive and negative pressure Plenums 22 and 23, the connection of negative pressure port 2 to negative pressure Plenum 23 and several cross-sectioned tubes 32 of Manifold 33 from positive pressure Plenum 22 through negative pressure Plenum 23 that each open to one of alternating Positive Pressure Orifices 31 in the top of Platen 4 with negative pressure Plenum 23 opening directly through alternating Negative Pressure Orifices 30 in the top of Platen 4. Additionally, the upper part of each tube 32 of Manifold 33 is shown recessed 52 below the opening in each Positive Pressure Orifice 31. Though not shown, the inlets and outlets of the Nozzles and Manifolds may be chamfered, or rounded to lower Fluid flow losses. Also shown are seals 50 and 51 to isolate positive and negative Plenums 22 and 23 from the surroundings and each other.

Figure 2E:
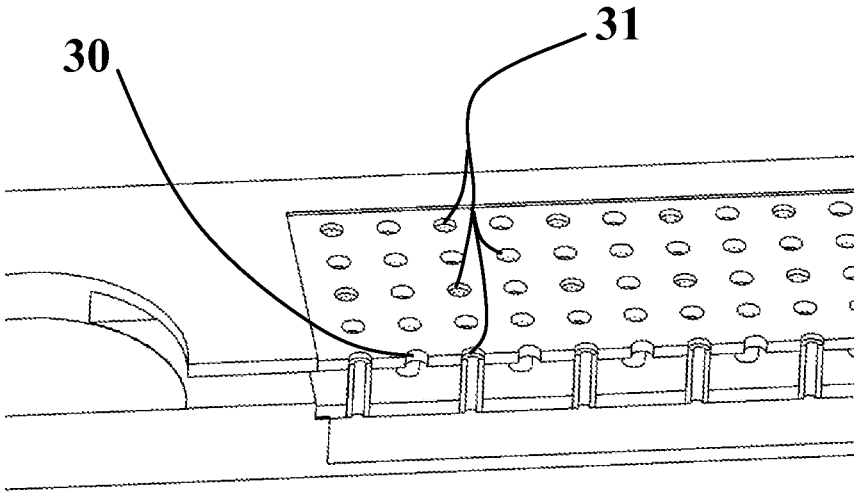

FIG. 2*e* shows a portion of the view of FIG. 2*d* from more of a top perspective view showing parallel rows of Orifices in Platen 4 with Negative and Positive Pressure Orifices 30 and 31, respectively, in each row alternating between them and in adjacent rows the positive and Negative Pressure Orifices are reversed.

The numbers and sizes and spacing of the Orifices, the Manifold components, the Plenums, and other details of the examples are variables which can be changed with the application and desired function of an implementation. The illustrations are not to scale, and the relative sizes or positions of the components are not necessarily as shown in the drawings.

At high Fluid flow rates, the design of the Manifold shown in FIG. 2*e*, that is, (typically) evenly spaced tubes 32 of uniform diameter can cause flow induced pressure drops in the negative pressure Plenum 23 as Fluid passes from the Negative Pressure Orifices through the negative pressure Plenum towards passage 20—as are well understood from the science of cross flow heat exchangers, which have similar physical designs. These pressure drops can upset the local pressures supplied to the Negative Pressure Nozzles, and result in changes in equilibrium position, $t_{equilibrium}$, of Media 5 relative to Platen 4, and are therefore undesirable.

Figure 11A:
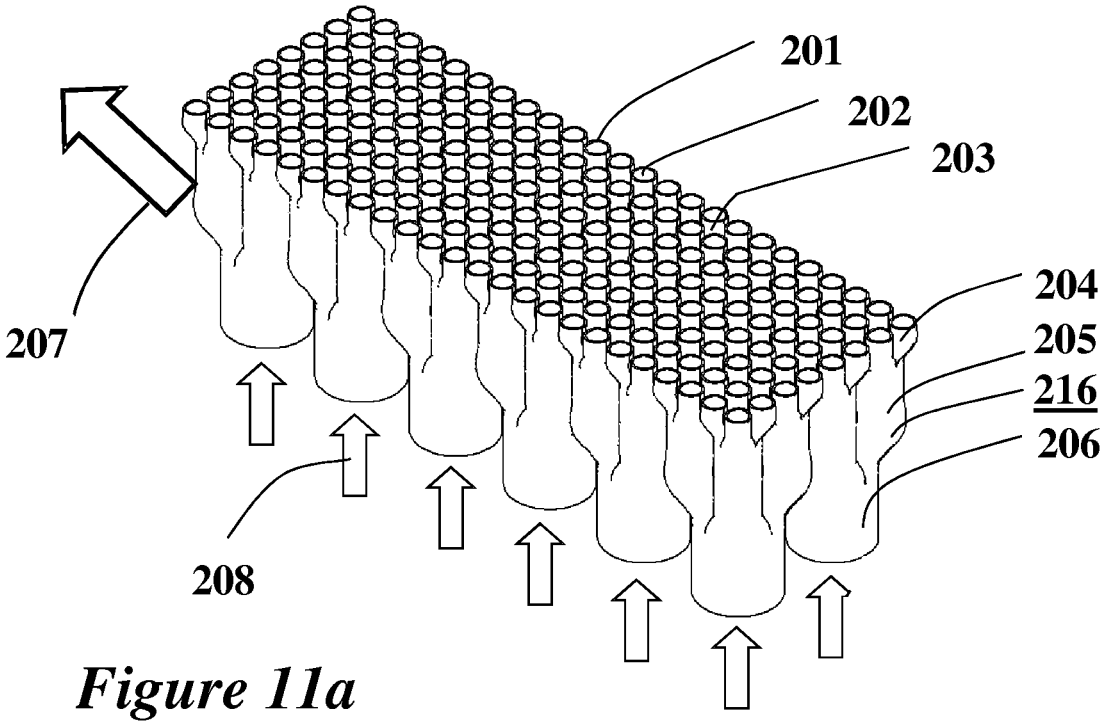
FIGS. 11*a* and 11*b* show alternative designs of the Manifolds which allow distribution of fluids at high flow rates, while maintaining uniform pressures throughout the Plenums.

An alternative design for the Manifold which minimizes such pressure drops is shown in FIG. 11*a*. In this figure, the Manifold elements (tubes) 32 of FIG. 2*e* are replaced by branched Manifolds 216, comprised of a single large tube 206, connected to four (4) smaller tubes 205, which are each, themselves, connected to still smaller tubes 204, which are connected to the Positive Pressure Orifices of the Platen (not shown for clarity). In this figure, arrow 208 shows the direction of Fluid flow from the positive pressure Plenum, not shown, through the branched Manifold element 216, to the Orifices (not shown). Elements 204, 205, and 206 are referred to as stages of Manifold 216. Small tubes 204 are positioned under the Positive Pressure Orifices of the Plenum, with the upper edge of said tubes, wall 201, connected to the lower surface of the Plenum. The radius of bore 202 in tubes 204 is used in calculations of flow resistance in Manifold 216, and length of tube 204 is the relevant length. Negative Pressure Orifices are positioned on the Platen between tubes 204, as shown by 203.

Figure 11B:
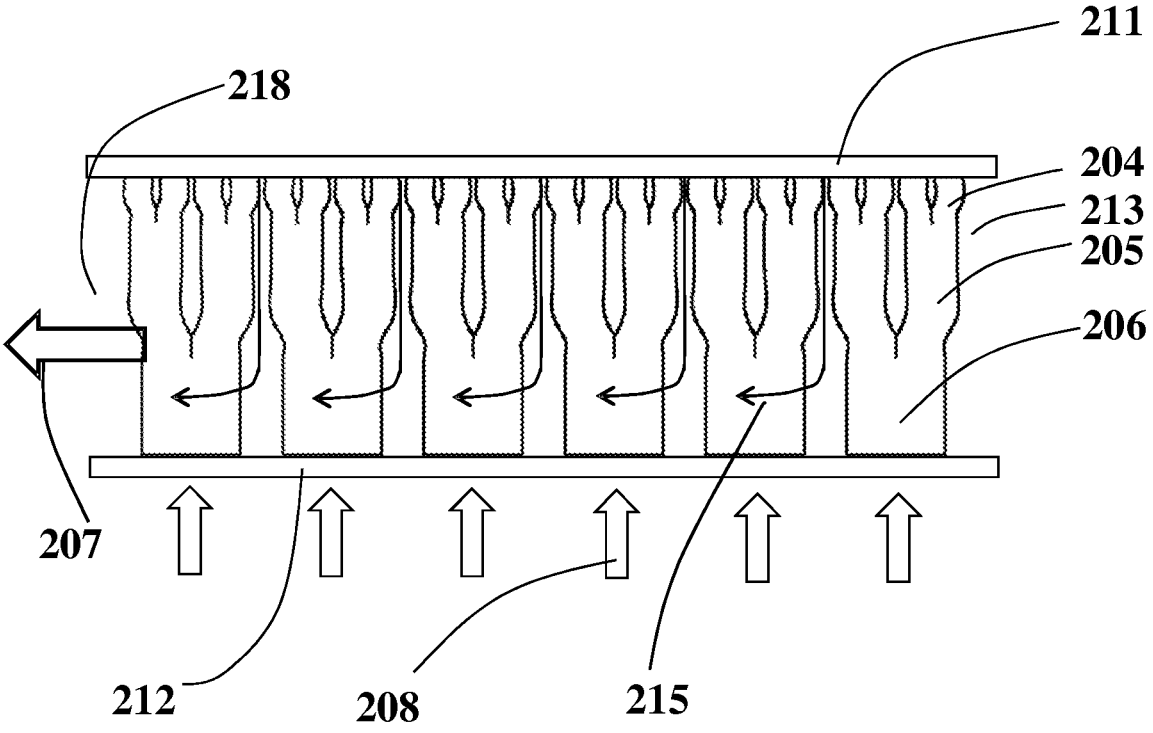

FIG. 11*b* shows a simplified cross section of the same branched Manifold 216 as in FIG. 11*a* however it now includes Platen 211, Plenum wall 212, and negative Plenum 218. Positive and Negative Pressure Orifices are not shown, nor are the holes in Plenum wall 212. In this view, arrows 215 show the path of Fluid passing through the Negative Orifices (not shown), vertically down between the closely spaced parts 204 of the Manifold 216, into more widely separated spaces between parts 205 and 206, then traveling laterally around more widely separated regions around part 206, and exiting the Plenum 218 as shown by arrow 207. This branched Manifold 216 has the desirable properties of having the flow resistance to Fluid traveling through it of the short section external to tubes 204, which is much less than the resistance would have been if 204 had been of the same diameter and the height of the Plenum 218. Furthermore, lateral pressure drop in negative Plenum 218 as a result of elements 206 is much less than would have been the case if element 204 were simply extended from the Platen 211 to Plenum wall 212 since, as is well known, pressure drops are proportional to the inverse of the smallest spacing dimension perpendicular to the Fluid flow raised to the third power. The Manifold 216 may have as many stages as desirable, and each stage may branch to successive stages with two or more branches. In this manner, the Manifold 216 and negative Plenum 218 may be designed to allow negligible pressure drops laterally in the negative pressure Plenum, and no additional pressure drops across Manifold 216 as a result of increased height of the Plenum 218.

Returning for simplicity of discussion to embodiments of the invention where high Fluid flow rates do not demand a branched Manifold such as shown in FIGS. 11*a* and 11*b*, FIGS. 2*b* and 2*c* are partial cross-sectional side views of the top portion of Platen 4 of FIG. 2, showing two tubes 32 of Manifold 33 from the positive pressure Plenum coupled to Positive Pressure Orifices 31 in Platen 4 and one negative pressure Orifice 30 from the negative pressure Plenum opening through Platen 4 with a sheet of Media 5 at a distance, t, above the Orifices in Platen 4. Also shown is the size of center bore 72 of tubes 32 of Manifold 33.

Figure 3:
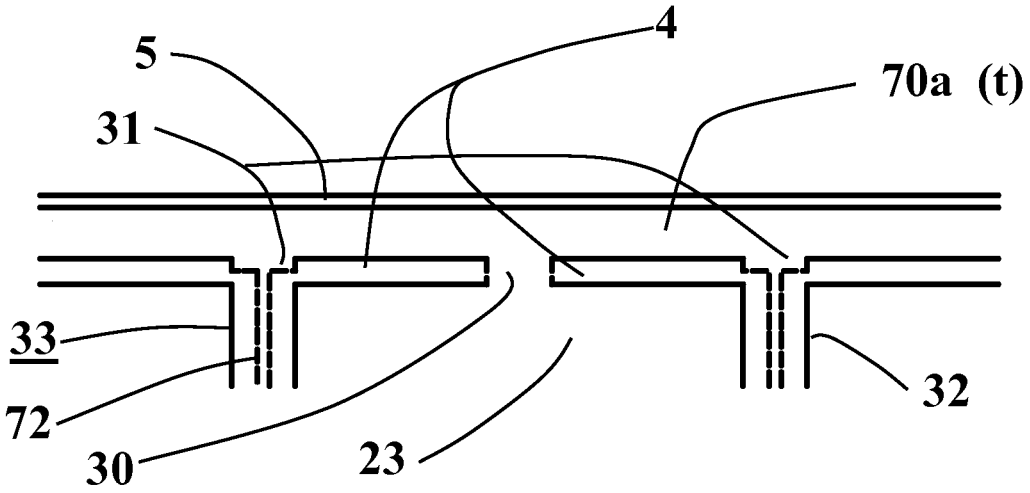
FIG. 3 is a schematic to illustrate the hydraulics between the Platen and the Media, illustrating how the Media to be Dried or Conditioned is held to a fixed distance above the Platen.

FIGS. 2*b* and 2*c* are included here to aid in the discussion of the hydraulics between Platen 4 and Media 5 relative to the position of Media 5 with respect to Platen 4. For purposes of this discussion, Media 5 in FIG. 3 is considered to be at the equilibrium position, $t_{equilibrium}$, above platen 4.

When Media 5 is very close to Positive Pressure Orifices 31 and Negative Pressure Orifices 30, Media 5 acts as a valve limiting the flow rate of Fluid through and between Orifices 30 and 31 to a level well below what it would be if Media 5 was further away from them, or not there at all.

With Media 5 in close proximity of Platen 4, between Positive Pressure Orifices 31 and Negative Pressure Orifices 30, there is a graduated pressure distribution, governed by the equations of fluid flow, which acts on Media 5 and Platen 4. If pressure is supplied to Positive Pressure Orifices 31 while Negative Pressure Orifices 30 are held at zero gauge pressure, then a pressure distribution develops between Media 5 and Platen 4. Similarly, if negative gauge pressure (partial vacuum) is applied to Negative Pressure Orifices 30 while Positive Pressure Orifices 31 are at zero gauge pressure, a corresponding pressure distribution develops. If both types of Orifices are pressurized, the resulting pressure distribution is the algebraic sum of the corresponding pressure distributions, and the average pressure over the bottom surface of Media 5 is the sum of the pressure distributions resulting from application of pressure to positive and Negative Pressure Orifices 31 and 30.

The Orifices 30 and 31 and central bore 72 of tubes 32 of Manifold 33 supplying pressure to Positive Pressure Orifices 31 are designed so when Media 5 is close to Platen 4, the spatial averaged pressure from the applied pressure at Orifices 30 and 31 is positive, and pushes Media 5 away from Platen 4.

When Media 5 is distant from Platen 4, i.e., beyond the equilibrium distance, the Fluid flows through Orifices 30 and 31 almost as freely as it would if Media 5 were not there. However, by design, there is a flow induced pressure loss at Positive Pressure Orifices 31 due to a series flow resistance deliberately designed into the size of central bore 72 of tubes 32 of Manifold 33 supplying Fluid to each of Positive Pressure Orifices 31. Thus the net pressure just above Positive Pressure Orifices 31 is significantly reduced to the point that the spatially average pressure applied to Media 5 becomes negative, thereby attracting Media 5 to Platen 4. One method of achieving a greater flow induced pressure drop prior to Fluid entering the Positive Pressure Nozzle is a long, thin Manifold central bore, 72, as shown. Alternatively, the Manifold could be designed somewhat larger in diameter, and have a constriction somewhere in it. Whatever method is chosen, it is an object of the geometry of the Fluid path to fix an equilibrium position, and Fluid flow rate at that position.

Therefore, there is a sharply defined equilibrium position for Media 5 which can be calculated based on standard fluid flow mathematics, and/or found experimentally. Alternative implementations, with different pressures applied from pressure sources 6 and 7, different Orifice sizes and geometries, for the Positive and Negative Pressure Orifices, and different flow induced pressure drops in the Manifold, or elsewhere, will allow somewhat different Media 5 to Platen 4 equilibrium separations. Fluid flow velocities, and Orifice separations can be optimized to enable efficient Drying and Conditioning, Manipulating and Shaping of Media 5, as can be determined by one skilled in the art, and are further described below.

Orifices 30 and 31 are spaced apart so the pressures above each Positive Pressure Orifice 31 and Negative Pressure Orifice 30 produce forces insufficient to bend either Media 5 or Platen 4 between the Orifices substantially compared to the equilibrium Platen 4 to Media 5 spacing. However, Orifice 30 and 31 spacing and pressure distributions can be designed so cumulatively Orifice supplied pressure distributions force Media 5 to conform to the shape of Platen 4, or alternatively, for Platen 4 to conform to the shape of Media 5, if Platen 4 is non-rigid. This capability of gradually deforming Media 5 can be used, for example, to hold an otherwise non-flat Media 5 to a flat shape over a wide area, as might be advantageous in the print zone of an inkjet printer, or to Manipulate, and possibly Condition or Dry, Media 5 in a curved path without friction in a printer. Alternatively, the capability to bend Media 5 can be used to transport Media 5 around corners with little friction.

In FIG. 3 with Media 5 in the equilibrium position, at the upper surface of Platen 4, the Fluid is constrained to travel between Platen 4 and Media 5, parallel to both. The Fluid then travels through Negative Pressure Orifices 30 to negative pressure Plenum 23, and then through passage 20 (FIG. 2*b*) to negative pressure port 2. From negative pressure port 2, the Fluid travels via conduit 8 to negative pressure source 6 (FIG. 1), which may comprise a pump, blower, or fan.

FIG. 3 shows a simplified, not to scale, cross section of the region of Positive Pressure Orifices 31 and Negative Pressure Orifices 30 in Platen 4, with Media 5 and separation 70*a* ($t_{equilibrium}$) between Platen 4 and Media 5. Manifold 33 is constricted to provide higher flow resistance through bore 72 than the flow path from Negative Pressure Orifices 30 to negative pressure Plenum 23. When Media 5 is close to Platen 4, the flow resistance between Positive Pressure Orifices 31 and Negative Pressure Orifices 30 is much greater than the flow resistance in bore 72 of tubes 32 of Manifold 33 supplying Positive Pressure Orifices 31. When the Media is close to the Platen and flow resistance is relatively high compared to that of bore 72, if the pressure supplied to bore 72 is 2 P, and the pressure applied to negative pressure Plenum 23 is −P, then the pressures above Positive Pressure Orifices 31 will also be 2 P, and the pressure above Negative Pressure Orifices 30 will be −P. The net spatially averaged pressure in the region surrounding Orifices 30 and 31 will be positive, tending to force Media 5 away from Platen 4. However, if Media 5 is distant from Platen 4, there is relatively low resistance to flow between the Positive Pressure Orifice and the Negative Pressure Orifice, and most of the pressure drop in the system is in bore 72 of Manifold 33, and the pressure at Positive Pressure Orifices 31 being negative. With Positive Pressure Orifice 31 pressure being negative, and Negative Pressure Orifices 30 pressure being negative, the spatial averaged pressure is negative, and Media 5 is attracted toward Platen 4.

There is an intermediate separation of Media 5 and Platen 4 where the spatially averaged pressure is zero, which is the equilibrium separation distance, $t_{equilibrium}$. Media 5 is held at this distance by the action of the Fluid in the conditions set by the Orifice sizes, geometry and separation, and the Manifold Fluid flow resistance and the positive and negative applied pressures by sources 7 and 6, respectively. This separation is stiff in the sense that there is a strong restoring force returning Media 5 to the equilibrium separation distance, $t_{equilibrium}$.

The following simple example illustrates how the equilibrium position is maintained. If the pressure drop across the length of bore 72 of Manifold 33 is W*R, where R is the Fluidic resistance and W is the volume flow rate, the pressure drop, for low Reynolds numbers flow, between Orifices 30 and 31 is of the form $F*W/t^3$, where F is a constant and t is the separation between Media 5 and Platen 4. The spatial average pressure applied to Media 5 is ($B_{positive}*P_{positive}+B_{negative}*P_{negative}$), where $B_{positive}$ and $B_{negative}$ are geometry dependent constants, and $P_{positive}$ is the pressure at Positive Pressure Orifices 31, and $P_{negative}$ is the pressure at Negative Pressure Orifices 30. For this illustrative example, we can take $B_{positive}$ and $B_{negative}$ to be the same constant B, and set $P_{positive}$ to be 2 P, and $P_{negative}$ to be −P. The spatial average pressure acting on Media 5 is then:

$$\begin{aligned} P_{Media} &= B_{positive} * (2P - W * R) + B_{negative} * P_{negative} = \\ &B * 2P - B * W * R - B * P \\ &= B * P(1 - (W * R / P)) \end{aligned}$$

But $W=3*P/(R+F/t^3)$, so that $$P_{Media}=B*P(1-(R*(3/(R+F/t^3))))$$

As t approaches 0, $P_{Media}$=B*P; i.e., positive. As t becomes large, $P_{media}$=−2*B*P; i.e., negative. There is an equilibrium spacing, $t_{equilibrium}$, where $P_{Media}$ is zero, implying no net force on Media 5, and that Media 5 is in a stable position. There actually are, of course, additional gravitational forces, however they are small relative to the Fluid pressures, so that gravitational forces only very slightly alter the equilibrium separation, $t_{equilibrium}$.

Since $P_{Media}$ is a strong function of t, the separation is stiff and stable. For turbulent flows, the relation between t and flow is an even stronger function of t, implying that for both laminar and turbulent flows, Media 5 is stiffly supported at an equilibrium distance $t_{equilibrium}$ that depends on the pressure ratios of the positive and negative pressure sources, and on the geometry of the Orifice sizes, Orifice spacings and the inner diameter, length, and shape of the elements of the Manifold, and hence the Manifold flow resistance.

In FIG. 3, the space 70*a* between Platen 4 and Media 5 is at equilibrium, $t_{equilibrium}$, the Fluid is moving and can impart heat, Reactants, or Additional Applied Material to Media 5 at much higher rates, and higher uniformity, than otherwise would be possible, and without a solid surface such as Platen 4 touching Media 5. By design, Orifice spacings and diameters, and Manifold geometry, supplied pressures, and area of Platen 4 are chosen so that the resulting separation, $t_{equilibrium}$, and flow rates achieve the desired boundary layer thicknesses for diffusion limited process at the surface of Media 5.

Figure 4:
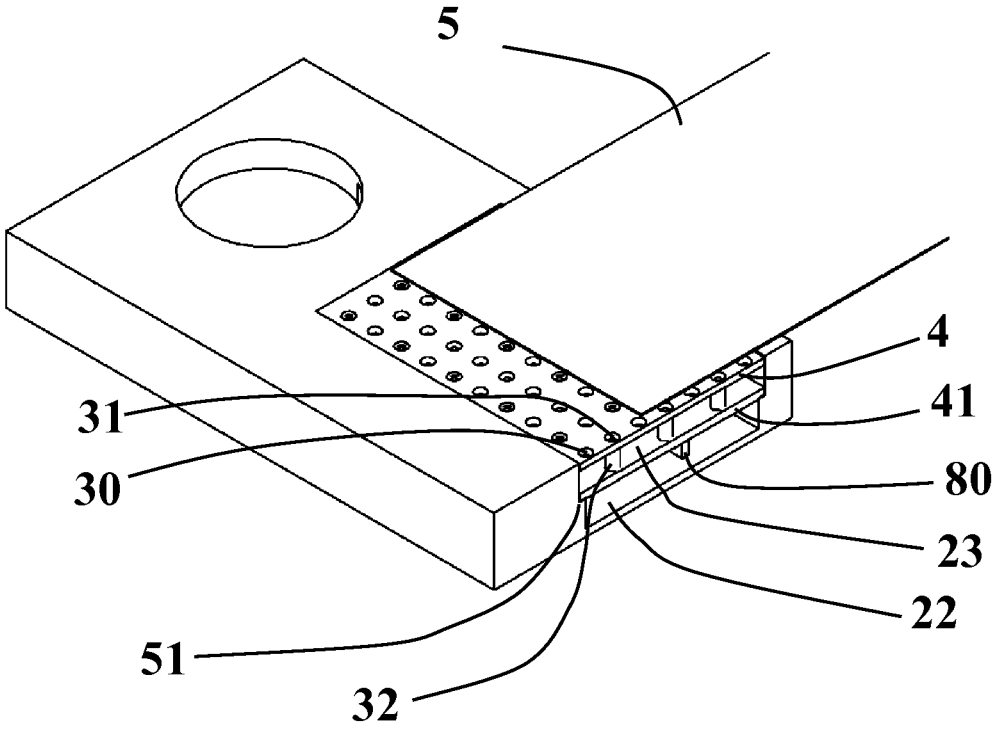
FIG. 4 is an enlarged short distance perspective vertical cross-sectioned view spaced-apart from the negative pressure port of the platen of FIG. 1.

FIG. 4 is an enlarged short distance perspective vertical cross-sectioned view spaced-apart from negative pressure port 2 of housing 1 of FIG. 1 showing Media 5 advanced partially across Platen 4, internal positive and negative pressure Plenums 22 and 23 of Platen 4, tubes 32 of Manifold 33 from positive pressure Plenum 22 connecting with Positive Pressure Orifices 31 in alternating rows at the point of the cross-cut with a longitudinally oriented heater element 80 coupled to upper wall 41 of positive pressure Plenum 22.

In this configuration, heat is used to accomplish Drying or Conditioning of Media 5. As shown in FIG. 4, the Orifice sizing, pressures, and Manifold are designed so the spacing between Platen 4 and Media 5 achieved is suited to efficiently heat Media 5 and any Applied Materials. Heater 80 which is in thermal contact with Plenum wall 41 and Manifold 33 and its tubes 32 heats the Fluid delivered to Positive Pressure Orifices 31 via tubes 32. In this configuration, the Fluid flow and the temperature to which the Fluid is heated is sufficient to provide the necessary heat for all the Applied Material on the underside of Media 5 to be evaporated, dried, cross-linked, catalyzed or otherwise conditioned. This is accomplished by selecting the pressure in the Positive and Negative Pressure Orifices of Platen 4 to provide the desired spacing between Media 5 and Platen 4 so that the Fluid flow within that space is sufficiently disbursed to provide a heat diffusion rate to the bottom of Media 5 for the Fluid to transmit substantially all the heat of the Fluid to Media 5. These conditions are easily met using inexpensive fans to provide pressure, and a small heater either external to Platen 4 assembly as in FIG. 1, or internal to Platen 4 assembly as in FIG. 4, to heat the Fluid. In this configuration, the Applied Material on the side of Media 5 closest to Platen 4 is heated directly by contact with the Fluid. The use of Fluid at a relatively high velocity enhances the heat transmission rate because it decreases the size of the thermal boundary layer, enabling the use of a smaller Media 5 to Platen 4 spacing than would otherwise be the case, which in turn puts all the heated Fluid in efficient thermal contact with Media 5.

A heater also may be designed so that said heater heats the air in the positive pressure Plenum 22 by making the heater in the form of a finned heat exchanger, or any other configuration that efficiently transfers heat to the Fluid. The heater may have a large heat capacity compared to the power applied, so it may average the energy required, minimizing peak power demand. This is particularly useful if the Fluid is recirculated, as described below.

In the configuration of FIG. 4, the Drying rate is further enhanced because the velocity of the Fluid removes the saturated vapor from Applied Material on Media 5 which saturated vapor would otherwise limit the evaporation rate. Thus the combination of confined, and therefore the relatively high velocity Fluid flow and short flow paths between Negative and Positive Pressure Orifices 30 and 31 which prevent the build-up of both thermal and vapor boundary layers results in significantly increased Drying rates and lower power consumption compared to prior art. As discussed in the Background of the Art above, the prior art that simply holds the paper to a platen, such as disclosed in U.S. Pat. No. 5,510,822, does not have the benefit of enhanced air flow and thin thermal and vapor diffusion boundary layers as provided in the current design.

To enhance the Drying/Conditioning process, suitable Reactants may be added to the Fluid to react chemically with the Applied Material, rendering the Applied Material immobile, or otherwise changing its properties, or the properties of Media 5. In the case of inkjet printing, it is important to keep these Reactants away from the Orifices of the inkjet print head—which is easily accomplished because all the Reactants are confined to the thin layer of Fluid between Platen 4 and Media 5 which is located after Media 5 has left the location of the print heads (see FIGS. 8*a* and 8*b*), stated another way, Platen 4 and the print heads are spaced apart a sufficient distance from each other, thus there can not be any interaction of the Reactants with the Orifices of the print heads.

In prior art, relating to inkjet printers, air jets have been used to enhance evaporation rates, but those air jets tend to disturb the flight path of ink droplets and, because the air jet width is much larger than the thermal diffusion layer, are inefficient in delivering warmed or high velocity air to the boundary layer. In the current designs, having all the Fluid movement between Media 5 and Platen 4, and in pairs of Positive and Negative Pressure Orifices 31 and 30, there is little possibility of disturbing Fluid outside the region between Platen 4 and Media 5.

It should be noted that the key is not to any specific arrangement of Positive and Negative Pressure Orifices, rather that the arrangement of Orifices create alternating regions of positive and negative pressure above Platen 4. Thus, the Orifices may be of different sizes, shapes and positioning.

Figure 5A:
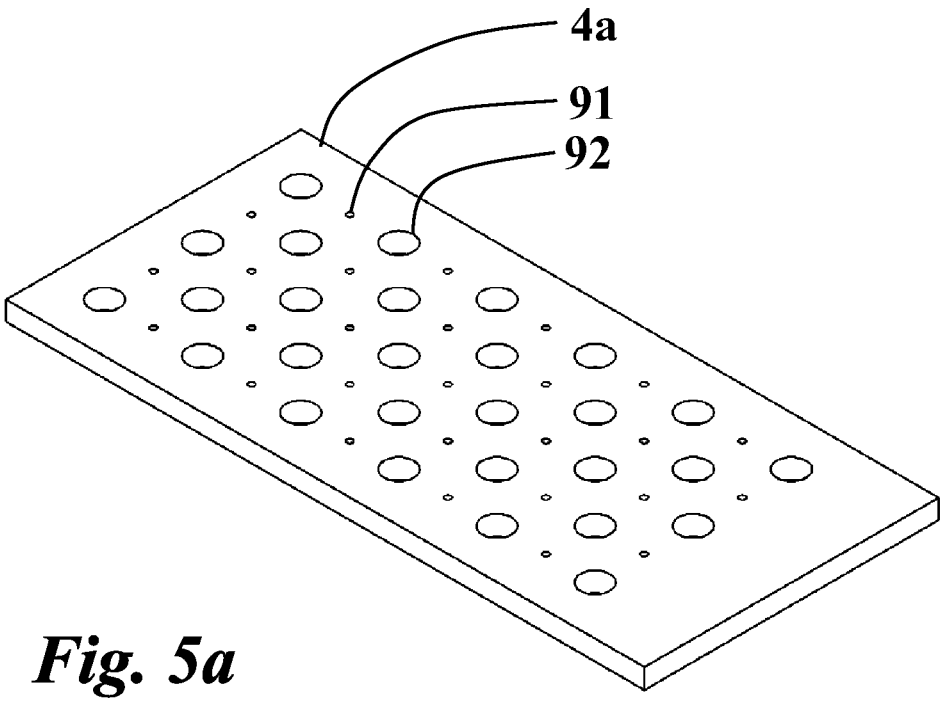
FIG. 5*a* is a perspective top view of a Platen having an alternating interlaced pattern of the Negative Pressure Orifices and the Positive Pressure Orifices with the Positive Pressure Orifices being substantially larger than the Negative Pressure Orifices.

In the example discussed above, with the Positive and Negative Pressure Orifices being the same size, it is necessary to have the supplied positive pressure from source 7 be greater than the absolute value of the negative pressure from source 6. However, this need not be the case if different sizes or configurations of Orifices are used. For example, FIG. 5*a* depicts an alternative Platen design of Platen 4 of FIG. 4. In FIG. 5*a* Positive Pressure Orifices 92 are significantly larger than Negative Pressure Orifices 91 with the Orifices in the same pattern as in previous figures; in so doing values of $B_{positive}$ are much greater than $B_{negative}$.

For example, if the Positive Pressure Orifice 92 has radius rp and pressure at the exit of the Positive Pressure Orifice 92 is $P_+$, and the Negative Pressure Orifice 91 has radius rn and pressure at the entrance of the Negative Pressure Orifice 91 is $P_-$, with the spacing between the centers of each of the Orifices is b, the average pressure on Media 5 is approximately:

$$P_{Media}=P_+*\{1-(rp/b)^2)/(2\ \ln(b/rp)\}+P_-*\{1-(rn/b)^2)/(2\ \ln(b/rn)\}$$

wherein ln is the natural logarithm, and the terms in { }'s (multiplying $P_+$ and $P_-$) are $B_{positive}$ and $B_{negative\ respectively}$, and are no longer equal.

Thus, one can chose the ratios of rp to rn such that if the pressure applied to the bore of 72 is P, not 2*P as above, there will still be a stable equilibrium position $t_{equilibrium}$. This allows the use of two identical pressure sources for the positive and negative pressure sources 7 and 6 respectively, or, as will be discussed later, the use of a single pressure source, if desired for cost or other reasons.

Figure 5B:
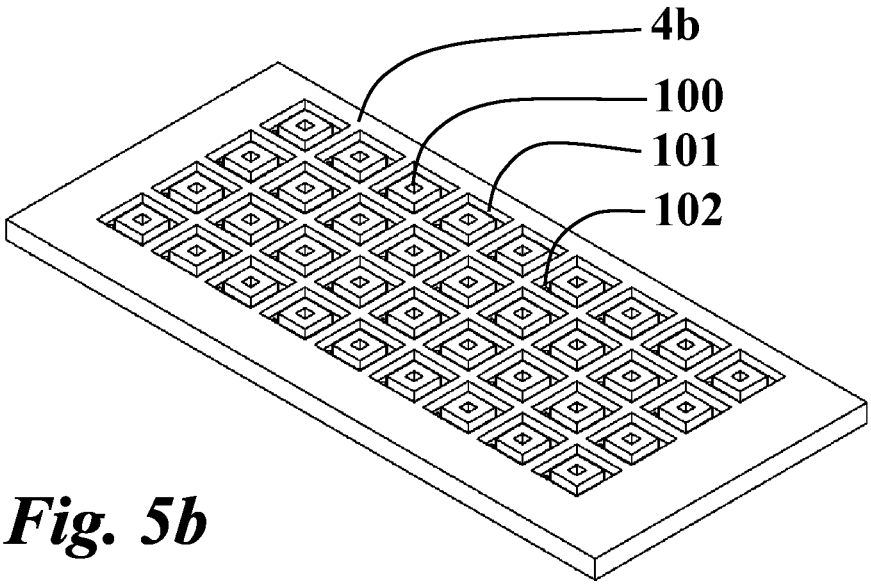
FIG. 5*b* is a perspective top view of a Platen that illustrates an alternative pattern of the Negative and Positive Pressure Orifices with the Negative Pressure Orifices surround by a square shaped groove that each includes an orifice (shown in the left most corner of the groove) that is coupled to the top end of a tube of the Manifold (not shown) from the positive pressure plenum.

FIG. 5*b* offers a different configuration of the Orifices than in previous figures. FIG. 5*b* is a perspective top view of Platen 4*b* having Negative Pressure Orifices 100 surround by a square shaped groove 101 that each includes a Positive Pressure Orifice 102 (shown in the left most corner of the groove) each of which is coupled to the top end of a tube of the Manifold (not shown—as discussed above) from the positive pressure Plenum 22. Here, $B_{positive}$ will be much greater than $B_{negative}$.

Figure 5C:
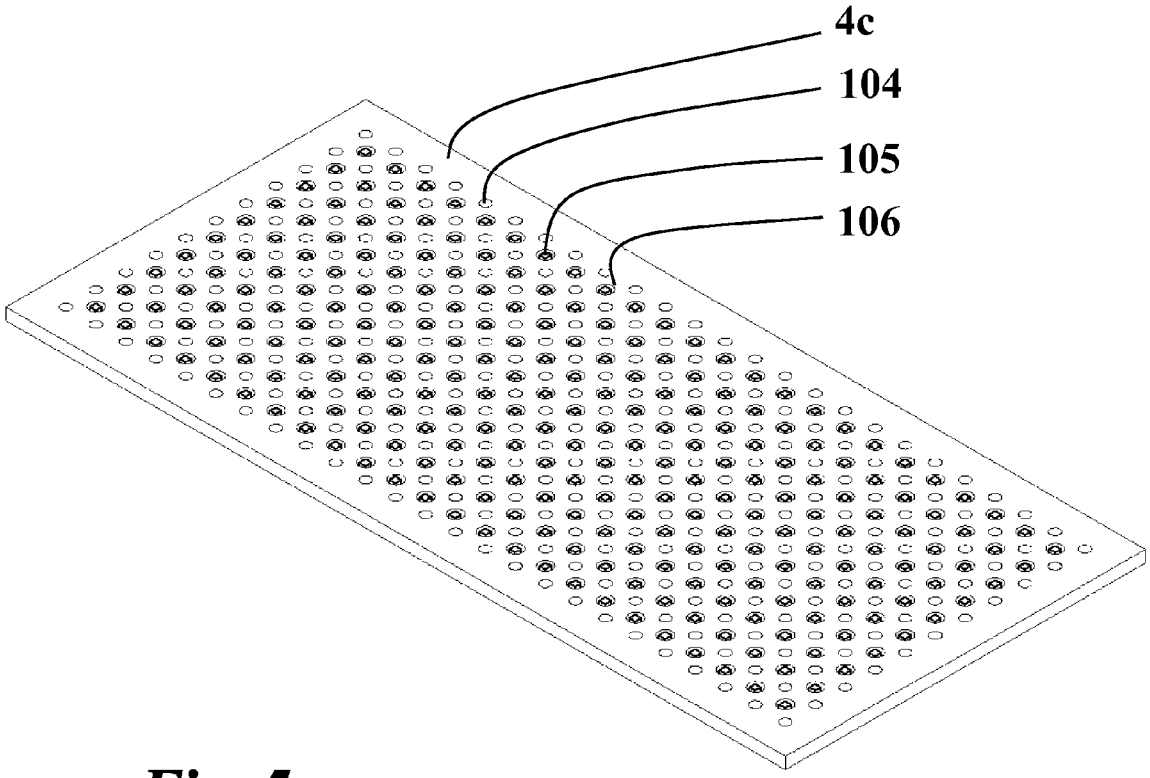
FIG. 5*c* is a perspective top view of an alternative Platen that illustrates a pattern of the Positive and Negative Pressure Orifices with individual radiation sources distributed among the orifices.

It is often desirable to introduce heat or radiation into region between the Platen and the Media, to, for instance, increase reaction rates. FIG. 5*c* is a perspective top view of an alternative Platen 4*c* that illustrates a pattern of alternating Positive and Negative Pressure Orifices collectively labeled 104 with individual radiation sources 105 in an array of recesses 106. This figure shows radiation sources 105 (which might be, for instance, light emitting diodes, or small microwave antennas) located in recesses 106 to avoid projecting above the Platen surface. The Positive and Negative Pressure Orifices 104 are, in this drawing, shown as equal size, and therefore are indistinguishable.

In this configuration, Platen 4*c* also serves to introduce radiation and/or electric and/or magnetic and/or electromagnetic fields into the reaction region between Media 5 (not shown) and Platen 4*c*. In recesses 106, there may be placed sources 105 of infra-red, visible, ultraviolet, or other radiation which may serve to enhance reactions or catalyze processes in the space between Platen 4*c* and Media 5. Similarly, electrodes which supply DC or oscillating fields may be placed in recesses 106. Platen 4*c* may also be made of a material that is transparent to such radiation or fields, and alternatively the radiation sources may be located in the bulk of Platen 4*c* or on the back surface of said Platen that is transparent to said radiation or said fields.

The local arrangement of Orifices, pressures, and Manifold sizes, may be different from region to region of a Platen to achieve different objectives of Platen 4 to Media spacing, and/or different local rates of processes. Some Orifices may be connected through valves (not shown) to vary the local rate of processes depending on whether the valves are open, closed, or partially open.

In Drying, often one of the objectives of Drying is to consume minimal power. In most of the alternatives mentioned throughout this patent, and in prior art, heating the Applied Material to increase its reaction rate, or diffusion rate, also requires heating Media that the Applied Material is in contact with, which wastes energy. In one alternative afforded by the Platen 4*c* configuration, infrared radiation, for example, absorbed selectively by the Applied Material and not Media 5, may heat the Applied Material much faster than heat is conducted by Media 5. Thus all the heat (in this example) will be supplied only to the Applied Material. To be more specific, in the case of an inkjet printer, with Media 5 being paper, paper is transparent to most infra-red radiation, whereas water absorbs the infrared radiation. When pulsed, high intensity infrared radiation is supplied by light emitting infrared diodes in Platen 4*c*, such that it heats the ink on the paper faster than about $1/10^{th}$ of a second, the water in the ink will evaporate before any substantial heat is transferred to the paper. For this technique to be effective, there must be sufficient airflow so that the vaporized water is carried off and not re-deposited on the adjacent paper. Similarly, radiation that is used to crosslink polymers, such as ultraviolet radiation, may be efficiently used, since such radiation is absorbed both by Media 5 and the Applied Material, is confined to the region between Platen 4*c* and the Media 5, and does not crosslink ink in nearby printheads.

Figure 6A:
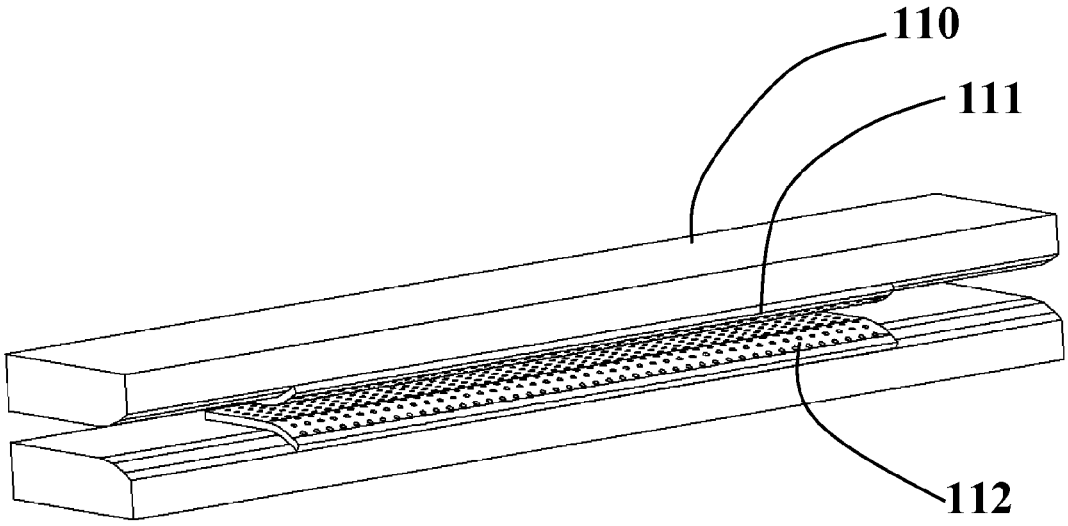
FIG. 6*a* is a perspective view of opposing curved upper and lower Platens with a wider initial opening to facilitate receipt of Media to pass between the two platens to treat both the top and bottom surfaces of the Media.
Figure 6B:
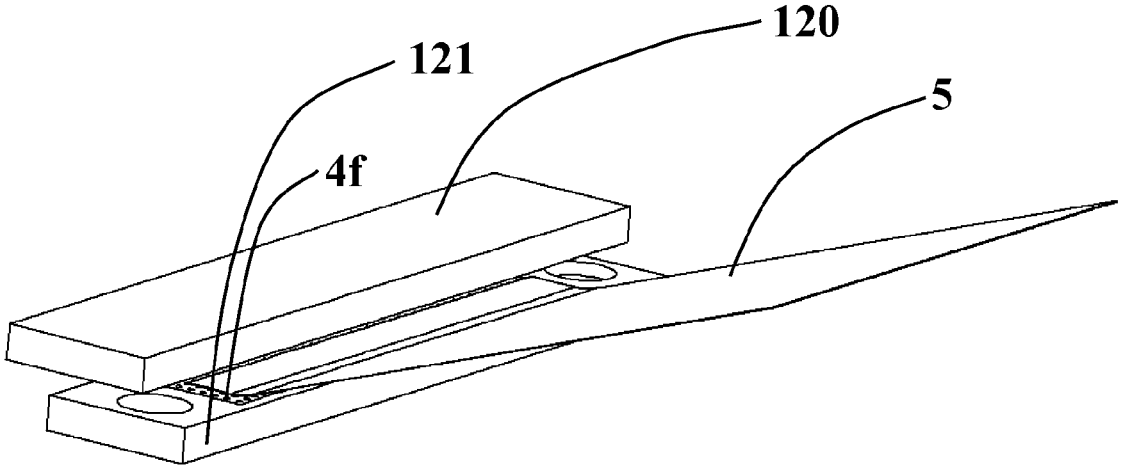
FIG. 6*b* is similar to FIG. 6*a* with both Platens being flat however staggered to receive Media entering at a slight angle.

The previous discussion centered around the use of a single Platen. However the Platen or Platens may be configured in various ways to Dry or Condition simultaneously, or successively, both sides of Media 5. FIGS. 6*a* and 6*b* are perspective views of opposing Platens 111 and 112 between which Media 5 (not shown in FIG. 6*a*) is directed for Conditioning, Drying, etc.

In FIG. 6*a* there is an upper Platen 111 and a lower Platen 112, with the Platens facing each other, and with the Media intake edges facing the Media input direction and said intake edges curved away from each other to more easily accommodate receipt of the leading edge of Media 5. Platens 111 and 112 are spaced apart from each other in the narrowest regions by a distance of about 2 times the equilibrium spacing, $t_{equilibrium}$, plus the thickness of Media 5. In this configuration, though not shown, the Orifices of each Platen will have Positive and Negative Pressure Orifices similar to that shown and discussed in relation to previous FIGS. 1, 2, 3, and 4.

In the double sided configuration shown in FIG. 6*a*, one may alternatively chose to supply pressure to the Positive Pressure Orifices, and allow the normally Negative Pressure Orifices to operate at ambient, i.e., zero gauge pressure.

FIG. 6*b* shows another double sided configuration with flat housings 120 and 121, that also serves to guide Media 5 into the space between them. Housings 120 and 121, and their incorporated Platens are operated with positive pressure supplied to the Positive Pressure Orifices and negative pressure applied to the Negative Pressure Orifices. Housing 121 and attached Platen 4*f* are positioned somewhat to the right of housing 120 and its corresponding Platen. Media 5 is shown approaching housing 121 and Platen 4*f* at a substantially slight angle, and is attracted toward Platen 4*f* by the pneumatic forces the Positive and Negative Pressure Orifices as described previously in relation to FIG. 3. As Media 5 advances, it is attracted to an equilibrium distance, $t_{equilibrium}$, parallel to the plane of Platen 4*f*, and enters the interior region between housings 120 and 121 without touching either Platen.

Figure 7:
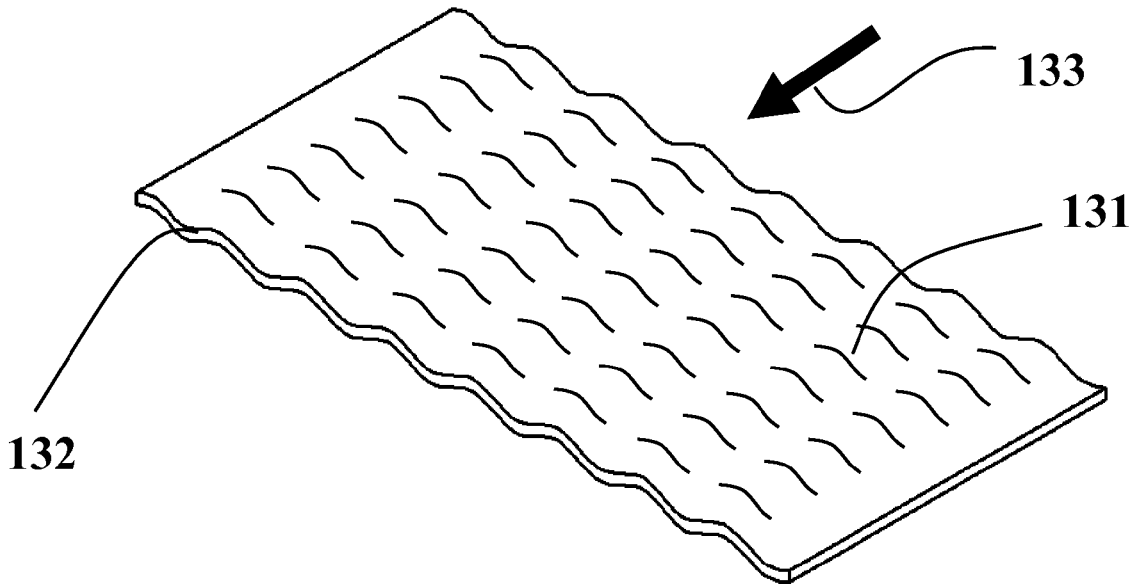
FIG. 7 is a perspective view of a Platen with a rippled top surface (orifices intentionally not shown to make the surface shape easier to visualize) to impart a rippled shape to the Media parallel to the path of travel to give the Media an enhanced three-dimension shape to improve its rigidity wherein increased rigidity minimizes the tendency for the media to flex closer to a printhead causing a head crash.

Referring to FIG. 7, the present invention may also be used to guide or deform Media 5 given that Media 5 will conform to an equilibrium position parallel to the surface of Platen 131, and separated from the Platen by a an equilibrium spacing, $t_{equilibrium}$, as long as the pressure necessary to deform Media 5 at any point in its path does not exceed the local maximum positive pressure pushing Media 5 away from Platen 131, or the negative pressure which occurs when Media 5 is several times the equilibrium distance from Platen 131.

FIG. 7 shows a Platen without showing the Orifices. Arrow 133 shows a Media direction of movement. The Media (not shown) shape will conform to shape 132 of Platen 131, and thus becomes temporarily corrugated, thus becoming stiffer as the Media cantilevers past the edge of Platen 131. Similarly, a Platen may be configured as any ruled surface to deform a Media. Examples of other ruled surfaces include cylinders and cones. Such shapes are useful in bending the Media around corners or turning the Media over.

A Platen may alternatively have any surface shape corresponding to an already similarly shaped Media. The Media may approach the Platen roughly perpendicularly to the Platen surface, and the Media may be drawn to the Platen, and held in place at spacing, $t_{equilibrium}$, from the Platen by the combined forces of the Positive and Negative Pressure Orifices. The Media may be attracted to the Platen from a slightly separated position by the hydraulic forces described in the text discussing FIG. 3. The Media may be disengaged from the Platen by turning off the hydraulic forces by changing one or more of the pressures supplying the positive pressure Plenum, or the negative pressure Plenum.

A Platen of various shapes may simultaneously deform, transport, Condition, or Dry the Media.

Figure 8A:
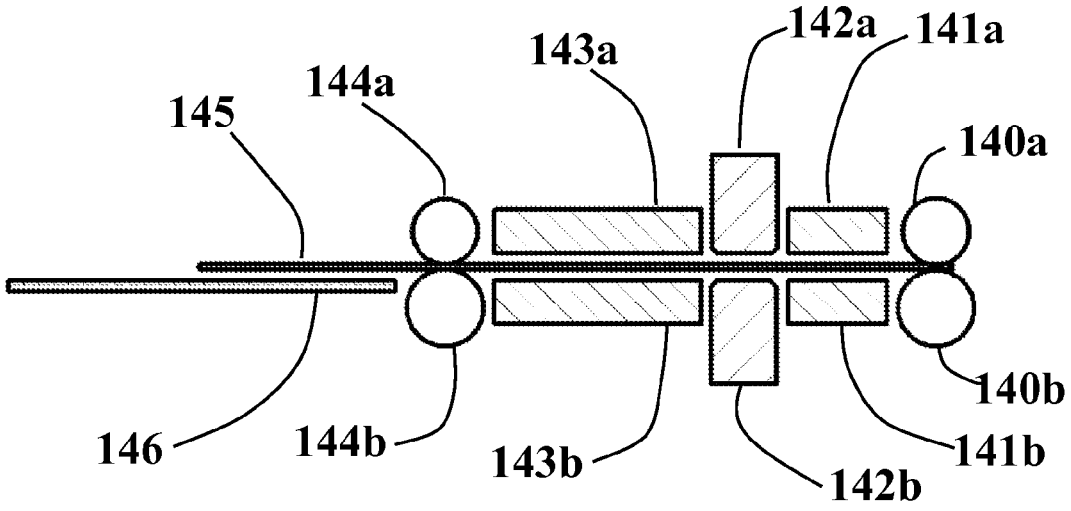
FIG. 8*a* illustrates a simplified schematic representation of a Media processing apparatus for simultaneously processing both the top and bottom surfaces of the Media at each step of the operation. Said Media processing apparatus is comprised of input and output pinch roller sets (with the Media feed from right to left through an optional Media surface treatment station), a dual print station, and opposing Platens to an output station.
Figure 8B:
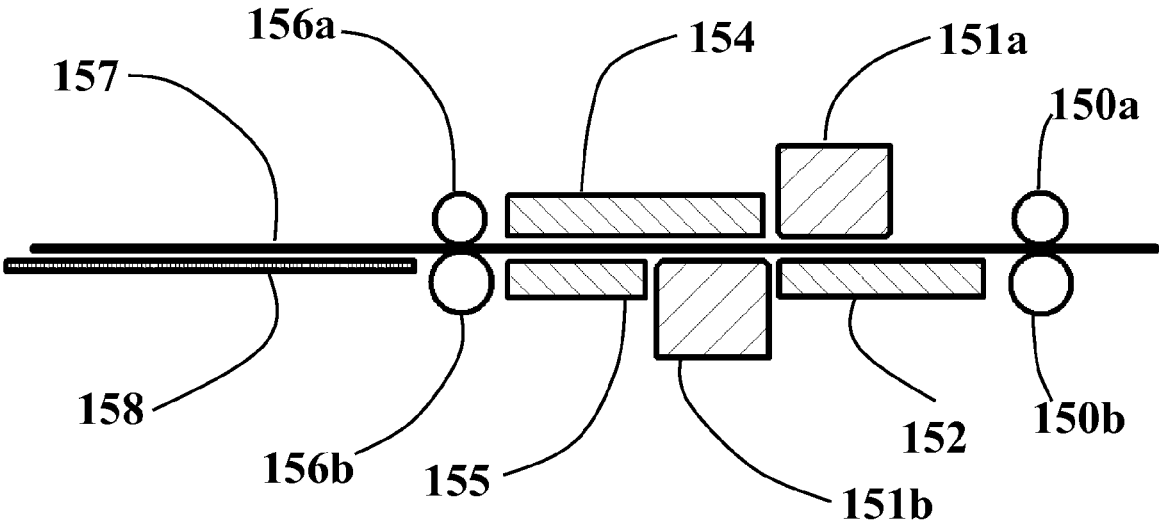
FIG. 8*b* illustrates an alternative Media processing apparatus for processing both sides of media with most of the processing of the top and bottom of the media performed at different times.

It is frequently desirable to process both sides of a Media simultaneously. FIG. 8*a* illustrates a simplified schematic representation of a Media processing apparatus for simultaneously processing both the top and bottom surfaces of Media 145 at each step of the operation, as might be part of an inkjet printer. In the case of an inkjet printer, one possible choice of Media is plain paper. FIG. 8*a* shows a sample delivery assembly in the form of input and output pinch roller sets 140*a,b* and 144*a,b* with Media 145 feed from right to left through an optional Media surface pretreatment station comprised of opposing Platens 141*a,b*; a dual print station 142*a,b*; and drying station comprised of opposing Platens 143*a,b* to an output paper tray 146. FIG. 8*b* illustrates an alternative Media processing apparatus for processing both sides of Media with most of the processing of the top and bottom of the Media performed at different times which is discussed more completely below.

Traditionally, inkjet printers have not been able to print simultaneously, or nearly simultaneously, on both sides of a sheet of paper because of the difficulty of Drying the paper with total volume of ink on the paper, and the difficulty in keeping ink from smearing where handling mechanisms necessarily would touch the paper to move it. The techniques discussed herein enables such printing of both sides since those techniques Dry the paper much more rapidly than previously possible, and since the paper is not touched through the processing steps other than advancing the paper through the apparatus at positions prior to printing and after the ink is already Dry.

Those steps and operations that are common to the configurations of both FIGS. 8*a* and 8*b* are addressed together.

FIGS. 8*a* and 8*b* each depict, schematically, a cross section of the paper path of an inkjet printer that incorporates the features of the present invention. In FIGS. 8*a* and 8*b*, paper 145/157, moves from right to left propelled by input pinch rollers 140*a,b*/150*a,b* initially advancing the leading edge of paper 145/157 prior to printing into the apparatus and output pinch rollers 144*a,b*/156*a,b* receiving the leading edge of paper 145/157 after printing/Drying/etc. and delivering paper 145/157 to output tray 146/158. Pinch rollers 140*a,b* and 150*a,b* may optionally preheat the Media by thermal conduction.

In FIG. 8*a*, Platens 141*a* and 141*b* through which the leading edge of paper 145 first advances serve to flatten or conform the paper to a desired shape, either flat, or corrugated, as discussed in relation to FIG. 7. Optionally, Platens 141*a* and 141*b* may heat the paper, or add material to the paper surface to enhance Drying or chemical reactions. Next paper 145 is transported between the print heads 142*a* and 142*b* where ink is selectively applied to one or both sides of paper 145. Print heads 142*a,b* may be scanning head print heads, or page width print heads, or multiple print heads each covering or scanning a portion of the width of the paper as, for example, described in U.S. Pat. No. 8,152,262 by Seccombe. Print heads 142*a,b* are separated from paper 145 a short distance on opposite sides thereof to maintain good print quality, and to not touch either side of paper 145. Paper 145 remains between print heads 142*a,b* less time than it takes the ink to form wet cockle, and then proceeds between opposing Platens 143*a* and 143*b* which rapidly Dry and Condition the paper as desired. Platens 143*a,b* may apply heat, Reactants, Additional Applied Material, or radiation to the paper (Media) to fix the Applied Materials, and accomplish other objectives such as keeping the ink from penetrating the bulk of the paper to the opposite side. During this Drying, Conditioning, guiding, and transporting, the paper is not touched, and is supported by the pneumatic forces of Platens in 141*a,b* and 143*a,b* as discussed more generally above with reference to FIG. 3, and FIG. 7. The Fluid and materials used by Platens 143*a,b* and 141*a,b* do not propagate substantially to print heads 142*a,b* thus preventing clogging of the Orifices of the print heads. As the Media, in this case paper 145, reaches pinch rollers 144*a,b* it has been Dried and Conditioned so there is no disturbance of the ink, nor transfer of ink to the rollers when exiting to output tray 146. The Media is then driven until it is stacked on output tray 146.

Another exemplary design is shown in FIG. 8*b* shows paper 157 in a paper path of a printer printing on both sides of the paper 157, with a very wide printhead 151*a*. Printhead 151*a* could be a scanning print head with a swath width of 2 inches or more, which is not used in the prior art because of the difficultly of keeping the paper flat in the print zone, and because the drying process cannot keep up with the print speed that 2 inch wide print heads can accommodate. Paper 157 is advanced by pinch rollers 150*a,b* and 156*a,b* as discussed similarly to 140*a,b* and 144*a,b* with respect to FIG. 8*a*. Paper 157 first passes over lower Platen 152 which provides a Dryer/Conditioner function and keeps the paper flat, and optionally initially heats paper 157 with first print head 151*a* next selectively printing the top surface of paper 157. As paper 157 advances, it passes below adjacent upper platen 154 which provides a Dryer/Conditioner/Shaper function, and maintains paper 157 flat, while the bottom of paper 157 is being printed by print head 151*b*. Paper 157 is then further Dried, Conditioned, and held flat by lower Platen 155. By the time paper 157 reaches pinch rollers 156*a,b*, both sides of paper 157 are fully Dried and Conditioned, and paper 157 is propelled to output tray 158 where paper 157 can be safely stacked without smearing the printed surfaces.

Though the Platens 141*a,b*, 143*a,b*, 152 and 154 are shown as being flat in the examples of FIGS. 8*a* and 8*b*, they may be curved, since they will hold the Media (paper) at a separation position, $t_{equilibrium}$, parallel to the Platen surfaces regardless of the shapes of same. Thus, the paper paths in FIGS. 8*a* and 8*b* may be curved to facilitate other objectives, such as fitting with reversers or stackers. Platens may be placed along the paper path as most suited for various functions including Drying, Manipulating, Conditioning, and Shaping as needed.

Figure 9A:
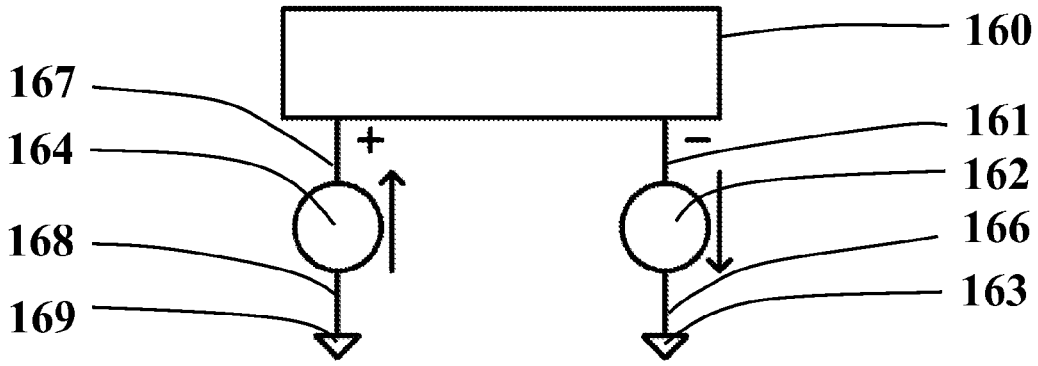
FIGS. 9*a*-*c* show various ways to supply and recirculate Fluid to the Platen.

FIGS. 9*a,b,c* are schematic representations depicting how pressure sources may be connected in various alternative configurations in the invention, with each configuration having distinct advantages.

In FIG. 9*a*, housing 160 includes a Platen that is driven by positive pressure source 164, which may optionally include heaters and sources of additional Applied Material or Reactants, and negative pressure source 162 through conduits 167/168 and 161/166, respectively, each with a port 169 and 163, respectively, to Fluid at ambient pressure.

In this configuration, if the Positive and Negative Pressure Orifices are of the same size and disposed as in FIGS. 2 *a-e*, positive pressure source 164 would have to have higher pressure than the absolute value of the gauge pressure of negative pressure source 162 to achieve a stable equilibrium point for Media 5. However, if the Positive and Negative Pressure Orifices are as those shown in FIGS. 5*a* and 5*b*, pressure sources 164 and 162 could have equal pressure magnitudes, though different signs, and a stable Media 5 position could be established. This configuration requires two separate sources of pressure, sources 164, and 162, and thus might be more expensive to produce, but the configuration has the advantage that the pressure sources can be independently set to different pressures relative to ambient.

Figure 9B:
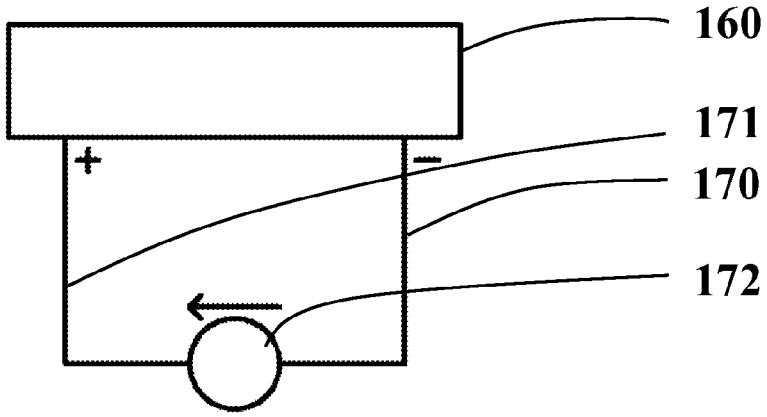

In FIG. 9*b*, housing 160 is driven by a single pressure source 172, which may also provide heat, Reactants, or additional Applied Material, replacing pressure sources 164 and 162 of FIG. 9*a*, simplifying the design, and allowing recirculation of Fluid, heat contained in the Fluid, Reactants, and additional Applied Material. Though simpler than the design of FIG. 9*a*, because there is only 1 pressure source, proper design of the rest of the system requires additional constraints on the Positive and Negative Pressure Orifices and Manifold designs.

Frequently it may be desirable to recycle only a portion of the Fluid, and introduce some new Fluid. This would be the case, for example, if the Fluid is cooled somewhat or the Reactants are depleted, or if there are unwanted reaction products.

Figure 9C:
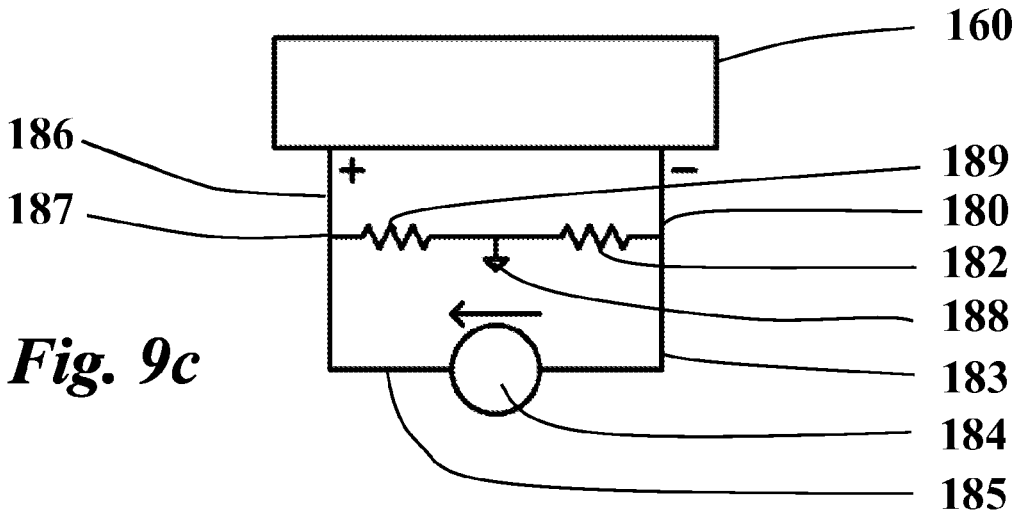

FIG. 9*c* shows a similar configuration to that of FIG. 9*b* with a portion of the Fluid selectively shunted through couplers 187 and 180 through variable slightly resistive conduits 189 and 182 with a source of ambient Fluid port 188 between couplers 187 and 180.

Thus, it is possible to use pressure sources of the same pressure (of opposite sign) to drive the positive and negative pressure inputs of the Platens, or even use a single pressure source to drive both ports, as illustrated in FIGS. 9*b* and 9*c*.

Example Inkjet Printer Design

The following is a detailed discussion of a low cost inkjet printer incorporating the features discussed above that includes a Dryer/Conditioner in the paper path.

Inkjet printers and ink jet inks that take advantage of the features disclosed above are able to:

1. Dry ink and paper more rapidly than about 2 seconds on the printed page without the use of expensive, power intensive, and bulky driers;
2. have sharp edge acuity when printed;
3. have dark blacks and vibrant colors; and yet
4. do not dry out, and clog Orifices of the printhead when the printer is not in use.

The design techniques discussed previously achieve the printing requirements of 1-4 above for an exemplary printer paper path by:

A. Confining all the air (Fluid) to a narrow region between the Media and the Platen, thus providing both high heat and mass transfer rates, and nearly unity efficiencies;

B. Using many Orifices to allow high flow rates with small pressure losses suitable for inexpensive fans;

C. Supporting the paper at the target flying height without friction;

D. Optionally recycling unused heat, and, Reactants or additional materials; and E. Taking advantage of the fact that, at high enough airflow (Fluid flow) rates, a large fraction of the latent heat of evaporation required will be supplied by unheated ambient air.

An exemplary inkjet printer Dryer/Conditioner is in the configuration of FIG. 4. Heat may be supplied by an electrically powered resistance heater 80 thermally connected to upper wall of positive pressure Plenum 41, and thence to tubes 32 of Manifold 33 and then to Platen 4. The Fluid air is pressurized as in FIG. 9*a*. Manifold 33 is designed to produce a flying height, $t_{equilibrium}$, of Media 5 which allows warmed air to travel between Media 5, in this case paper, and Platen 4. The paper has been previously printed on the side closest to Platen 4. The use of forced convection dramatically increases the heat transfer rate to the paper, and the removal of vapor from the paper compared to prior art techniques.

Principles of Operation

The evaporative process requires a gradient of water concentration, between the Applied Material surface (in this case, water in the ink) and the Fluid environment (in this case air), which supports a diffusion process. The water vapor concentration at the surface of the paper is determined by the maximum saturated water possible in air at the surface temperature, as is known from psychometric charts. The higher the temperature, the higher the water vapor saturation concentration, the higher the gradient, and hence the higher the evaporation rate. However, when water is evaporated from a surface, the evaporated water absorbs and takes with it a corresponding latent heat of vaporization.

That heat must be replaced from one of three sources:

A. the bulk of the substrate (i.e., paper) on which the water resides;

B. the heat from the (forced convection) ambient air which is at a temperature above the evaporatively cooled temperature of the water surface; and C. heat of the water itself from temperatures above the temperature of the evaporatively cooled equilibrium temperature (generally a small contribution to the total heat needed).

The water vapor concentration gradient, $\Delta C_{water\ vapor}/\Delta x$, is also partly determined by $\Delta x$, the distance over which the gradient occurs. In natural convection over a piece of paper, the separation distance between the surface of the paper and ambient water saturation (boundary layer thickness) is a significant fraction of the size of the paper. However, in forced convection, as in this invention, the boundary layer can be made very small—thus increasing dramatically the evaporation rate.

Since the water gradient is influenced by the water vapor pressure in the channel between the Platen and the paper, the input air (Fluid) must have enough capacity for vapor generated so that the gradient persists as water is evaporated.

There is another gradient that is important—that of temperature from the air between the Platen and the paper. That gradient determines the rate of heat flow from the air to the water surface on the paper, providing heat mentioned in subparagraph B above. Again, making the space between the paper and the Platen much smaller than in the thermal diffusion length (thermal boundary layer) in natural convection, by forced internal convection allows a much greater heat transference rate, in a smaller space, than would otherwise have been possible.

In normal unforced thermal convection, the heat transfer rate between two planes is:

$$Q=(k*A*\Delta T)/t_{separation}$$

where Q is the rate of heat transfer, $t_{separation}$ is the spacing between source and sink, k is the thermal conductivity of air, A is the surface area of the Platen and Δt is the temperature difference between the air and the Platen.

In forced convection, the local heat transfer rate is $$Q=(Nu*k*A*\Delta T)/D_h$$

where $D_h$ is the hydraulic diameter, and in this case it corresponds to $2*t_{equilibrium}$. Nu is the dimensionless Nusselt number, reflecting the geometry, velocity, and viscosity of the Fluid.

If the airflow is low enough that the air passing over the page is saturated with water vapor at ambient temperature, there will be no evaporation, and no evaporative cooling. Hence, one goal of the invention as applied to inkjet printing is to provide adequate airflow, which provides both a destination for the water vapor from the ink, and heat of vaporization to allow the water in the ink to evaporate.

There are multiple approaches to drying which are differentiated by the source of heat. They include providing heat by preheating the Media, by heating the Media from ambient air as it passes between the Platen and Media, by heating the Media with preheated air as it passes between the Media and the Platen, and by using heaters located within the Platen itself.

If the airflow between the Media and the Platen is fast enough to not become saturated with water vapor, the surface ink temperature will drop to the wet bulb temperature corresponding to the water content of the ambient air—which for 20° C. ambient air with 20% relative humidity is −5° C. Then the surface ink will remain at the wet bulb temperature, and there will be a 25° C. difference between the ambient temperature of the air and the surface ink. Heat will flow to vaporize the ink from: the paper; from the remaining initially room temperature ink; and from the air that is being driven through the Orifices. The temperature difference between the ambient and the wet bulb temperature times the thermal capacity of the paper and the ink will provide 122 out of the 368 joules required to evaporate ink from the page. The air driven through the Orifices, if ambient air at 20° C., will have a 25° C. temperature difference to supply the remaining heat. If the Fluid (air, in this case) is heated above ambient temperature, the wet bulb temperature of the paper corresponding to the Dry bulb temperature of the heated air will provide a temperature gradient that is the difference between the wet bulb, and the Dry bulb temperature for the air.

The relevant equations for combined mass transfer and heat transfer in the case of evaporation of water in ink on a surface are:

A Mass Transfer (by diffusion/forced convection) Equation:

$$\frac{dm_{ink}}{dt} = \frac{-D*Sh(C_s[T_{ink}]-C_{in}[T_{in}])A}{2*t}$$

And a Heat Transfer (by diffusion/forced convection) Equation:

$$M_{paper}C_{paper}\frac{dT_{ink}}{dt} + H_{ink}\frac{dm_{ink}}{dt} = \frac{Nu(T_{in}-T_{ink})A*k}{2t}$$

where $M_{ink}$=the mass of the water in the ink

D=water vapor diffusion coefficient in air

Sh=the dimensionless average Sherwood number $C_s[T_{ink}]$=the saturation concentration of water vapor at temperature $T_{ink}$ at the surface of the ink $C_{in}[T_{in}]$=the water vapor concentration in the supplied Fluid (air), at temperature $T_{in}$ $T_{ink}$=the temperature of the ink, and the paper it is on $T_{in}$=the temperature of the air supplied t=the thickness of the channel in forced convection $H_{ink}$=the heat of vaporization of water in the ink Nu=the dimensionless average Nusselt number k=the thermal conductivity of the Fluid (air)

$M_{paper}$=the mass of the paper $C_{paper}$=the specific heat of the paper

A=the area of the paper

In this case, Sh and Nu are both the same function of velocity of the airflow, and geometry, and viscosity of the Fluid. In the above the brackets [ ] mean "as a function of".

Combining these equations leads to a single differential equation for ink temperature $T_{ink}$.

$$\frac{dT_{ink}}{dt} = \frac{-A(H_{ink}*Sh*D(C_s[T_{ink}]-C_{in}[T_{in}])]-Nu(T_{in}-T_{ink})k)}{2t*M_{paper}*C_{paper}}$$

Thus if $T_{ink}$ starts at an ambient temperature, and there is air flowing, the Nusselt and Sherwood numbers will be non-zero, and the ink will cool since the first term on the right hand side will be much larger than the second term, and ink will evaporate rapidly. As the ink evaporates and cools, $C_s[T_{ink}]$ decreases dramatically, since saturation concentrations are exponential functions of 1/temperature, to the point where the two terms on the right hand side are equal, and further cooling stops. This temperature is defined as the dew point, $T_{dew}$. When the ink and the paper it is sitting on are no longer cooling, by the mass transfer equation above, the water vapor in the ink is still evaporating.

$$\text{Since, } \frac{dT_{ink}}{dt} = 0,$$

from the heat transfer equation, then $$\frac{H_{ink}dm_{ink}}{dt} = \frac{-Nu(T_{in}-T_{dew})A*k}{2t}$$

and therefore, $$\frac{dm_{ink}}{dt} = \frac{-Nu(T_{in}-T_{dew})A*k}{2tH_{ink}}$$

As the ink is transitioning from its initial temperature to the dew point, a certain amount water in the ink is evaporating. That amount is just that amount that can be vaporized by the latent heat of vaporization supplied by the transition of the paper from its initial temperature to the dew point.

Thus, after a short delay when a fraction of the ink is evaporated as the ink and Media moves to the dew point (essentially, flash evaporization), heat transfer from the Fluid (air) supplies the heat to evaporate the remaining water in the ink. When the water in the ink has vaporized, the Media and ink temperature begins to rise from the dew point towards the temperature of the supplied air.

Thus a model for the time required to evaporate the ink on a page is simply the time for a heat exchanger formed by the paper and the Fluid (air) flow to supply the heat of vaporization for the water remaining after the initial cooling phase where the ink temperature lowers to the dew point.

In current typical printers, about $\frac{1}{3}^{rd}$ of the water initially on the page can be flash vaporized by the transition of the paper temperature from its initial (usually, room) temperature to the dew point. The remaining water must have heat transferred to it through either heating the paper prior to printing, supplying heat from ambient air, or supplying heat from heated ambient air.

Even in the case of the Media thermal mass being adequate to supply all the heat necessary to flash evaporate the water in the ink, there still needs to be an airflow to maintain a water vapor gradient. However, the amount and velocity of that air can be considerably less than in the case where externally supplied heat via heated air is required.

Thus the forced convection described in this invention is suitable for both situations, though the design parameters are different.

The choice of a design for an inkjet printer Dryer includes:

1. To the extent possible minimizing the amount of water on the page through parsimonious print modes, the use of small drop volumes, use of some surfactants (to spread ink to the extent allowable by print quality needs, permitting lower drop volumes) and appropriate dye loading (to maintain optical density with less actual Fluids);
2. maximizing the heat capacity of the substrate (by using thicker paper) relative to the heat necessary to evaporate ink solvents (by using less solvents, or solvents with lower heat of vaporization);
3. Optionally, preheating the paper before printing
4. Designing a forced convection dryer with optional heat exchanger, that supports the Media at a height $t_{equilibrium}$ consistent with the needs of efficient heat exchange and total required airflow, including choice of:
   a. diameter, shape and spacing of the Orifices;
   b. Diameter and length of the Manifold elements;
   c. Plenum parameters;
   d. Heat supplies for the input Media, and/or the air (Fluid), if any; and
   e. Fan pressure and capacity.
5. Optimizing those parameters to minimize important variables such as power consumption, Platen area, system cost, and result in convenient Media to Platen spacing.

In general, a number of simultaneous constraints must be met by design parameters including:

Heated Air Mass Per Page Equation:

The mass of air moving through the heat exchanger, multiplied by an efficiency factor must supply the necessary heat of vaporization not already supplied by the thermal mass of the paper.

$$M_{air}*C_{air}*(T_{in}-T_{dew})*\eta_{heat\ exchange}+M_{paper}*C_{paper}*(T_{paper\ initial}-T_{dew})>=H*m_{ink}$$

Where $M_{air}$=Mass of air required to process one page $C_{air}$=the specific heat of air $\eta_{heat\ exchange}$=the efficiency of the heat exchanger $M_{paper}$=the Mass of a sheet of paper $C_{paper}$=the specific heat of paper $T_{paper\ initial}$=the paper temperature entering the plating region Heat Transfer Efficiency-Airflow Equation:

The efficiency of the heat exchanger is consistent with Fluid flow rate, and the geometry of the heat exchanger. For a parallel plate heat exchanger, that relationship is described by:

$$-ln\ [1-\eta_{heat\ exchange}]=k*A*Nu/(2t*M_{air}*C_{air})$$

Where:

k=the air thermal conductivity

M=the air mass flow rate

We want the efficiency to be greater than required, so the equation above is written as a constraint:

$$-ln\ [1-\eta_{heat\ exchange}]<k*A*Nu/(2t*M*C_{air})$$

Dry Air Mass Per Page Equation

The air moving over the paper must be able to absorb all the moisture in the ink. That air can absorb at most the difference in its current moisture content, and its saturated air content. Thus, analogous to the Heated air mass per page equation above, there are equations for minimum amount of air that must be passed over the paper, and for the efficiency of that absorption process.

$$M_{air}(C_{sat}[T_{in}]-C_{in}[T_{in}])>=M_{ink}$$

Where:

$C_{sat}[T_{in}]$=the saturation concentration of water at air temperature $T_{in}$ $C_{in}[T_{in}]$=the actual concentration of water at $T_{in}$ Mass Transfer Efficiency-Airflow Equation:

Analogous to heat exchangers, there is an efficiency in transferring mass, described by a similar relationship:

$$-ln\ [1-\eta_{mass\ transfer}]=\rho_{air}*D*A*Sh/(2t*M)$$

Where:

$\eta_{mass\ transfer}$=the mass transfer efficiency

D=the air diffusivity $\rho_{air}$=the density of air (or Fluid)

Analogous to the heat flow efficiency equation above, the requirement to achieve a given efficiency is therefore expressed as $$-ln[1-\eta_{mass\ transfer}]<\rho_{air}*D*A*Sh/(2t*M)$$

Since, when air is the Fluid, $\rho_{air}*D$ is almost exactly equal to $k/C_{air}$, mass and thermal transfer efficiencies are approximately equal. However, since the ambient air has typically much more capacity for absorbing the water in the ink than the warm air has energy to supply heat, the required mass transfer is lower, and hence the mass transfer efficiency does not provide a design limitation.

However, in the case where the Media has sufficient heat capacity to vaporize all the water, the Heated Air Mass per Page, and the Heat Transfer Efficiency-airflow inequalities would no longer be a constraints, but the Dry Air Mass per Page equation, and the Mass Transfer Efficiency-airflow equation would still be constraints.

Air Flow Volume Equation

The flow rate of air per page per second is consistent with the number of pages per minute to be printed.

$$M=(M_{air}*\text{ppm}/60)$$

Where:

ppm=Pages per minute

Wet Bulb Temperature (Also Called Dew Point) Definition

The wet bulb temperature (also called the dew point temperature) is determined by the ambient temperature of the input air, and its water content. $T_{dew}$ can be found by solving the following Clausius-Clapeyron equation:

$$T_{in}-T_{dew}=2.07*10^3*((1.34*10^6 exp(-5295/(273+T_{dew}))-C_{in})$$

Pressure-Flow Equation

The pressure from the blowers just equals the flow resistances in the Fluid path. Thus the pressure drops from the Manifolds, Orifices and the region of Fluid between the paper and the Platen must be just equal to the assumed driving pressures from the positive and negative blowers, at the required flow rates. Pressure drops may have terms both linear in flow velocity, and quadratic in flow velocity. Equations for the flow losses due to linear terms are derived from Hagen-Poiseuille equation for various geometries.

The pressure-flow relationship is:

+Positive pressure from the positive source

−pressure drop in positive Manifold [=a term linear in velocity—Loss pl]

−pressure drop in positive Manifold [=a term quadratic in velocity—Loss pq]

−pressure drop between Orifices [=Loss pmemb]

−pressure drop in Negative Orifice [=a term linear in velocity—Loss nl]

−pressure drop in Negative Orifice [=a term quadratic in velocity—Loss nq]

−Negative pressure from the negative source=0 (negative pressure is a negative number)

Each of the pressure terms in the pressure-flow equation just above can be expressed in the terms of geometrical and other design parameters. Substituting geometrical and other design parameters in the simplified equation just above, the pressure-flow relationship is expressed in an equation with 7 corresponding terms on the left hand side (below):

$$\begin{aligned}
&P_{pos}\\
&\frac{-8M\mu lbp*4b^2}{rm^4\pi A} && [=\text{Loss } pl]\\
&-(M4b^2/(rm^2\pi A))^2(1.48/2)\rho C_{qp} && [=\text{Loss } pq]\\
&-(6\mu M4b^2/(\pi t^3 A))\ln(b^2/(4rprm)) && [=\text{Loss } pmemb]\\
&\frac{-8M\mu lbn*4b^2}{rn^4\pi A} && [=\text{Loss } nl]\\
&-(M4b^2/(rn^4\pi A))^2(1.48/2)\rho Cqn && [=\text{Loss } nq]\\
&-P_{neg}\\
&=0
\end{aligned}$$

Where $P_{pos}$=the positive blower pressure

M=the air mass flow rate b=the Orifice spacing rm=the radius of the positive Manifold lbp=the length of the small diameter part of the positive Manifold A=the area of the Platen $C_{qp}$=a coefficient between 0 and 1 reflecting how much pressure is loss is incurred in expansions and contractions near the positive Orifice and is greater if the expansions and contractions are sharp ρ=the air density t=the spacing between Media and Platen rp=the radius of the Positive Pressure Orifice μ=the viscosity of air rn=the radius of the Negative Pressure Orifice lbn=the length of the Negative Pressure Orifice bore $C_{qn}$=a coefficient between 0 and 1 reflecting how much pressure is loss is incurred in expansions and contractions near the negative nozzle, and is greater if the expansions and contractions are sharp $P_{neg}$=the negative blower pressure Loss pl=the flow induced pressure loss term at the Positive Pressure Orifice that is linear in Fluid velocity Loss pq=the flow induced pressure loss term at the Positive Pressure Orifice that is quadratic in fluid velocity Loss pmemb=the flow induced pressure loss term in the region between the Orifices Loss nl=the flow induced pressure loss term at the Negative Orifice that is linear in fluid velocity Loss nq=the flow induced pressure loss term at the Negative Orifice that is quadratic in fluid velocity Force Balance Equation:

The sum of all the forces caused by fluid pressure must, at the equilibrium height, $t_{equilibrium}$, be zero.

Pressure at Positive Pressure Orifice*geometry factor+Pressure at Negative Pressure Orifice*geometry factor+Pressure from Change in momentum of Fluid=0

That is mathematically stated as:

$$(P_{pos}-\text{Loss}pl-\text{Loss}pq)*(1-(rp/b)^2)/(2\ln(b/rp))+(P\text{neg}+\text{Loss}nl+\text{Loss}nq)*(1-(rn/b)^2)/(2\ln(b/rn))+\text{Change in momentum of Fluid}=0$$

In many cases the "change of momentum contribution" of the Fluid can be made small, and is neglected here. Depending on the actual geometry, one may include a correction term for the Fluid momentum contribution, or use a 3-d Fluid flow model to compute the forces more accurately.

Force Asymptote Equation:

In addition to balancing the forces at the equilibrium position, it is important that at t much larger than the desired equilibrium position, $t_{equilibrium}$, there is a strong restoring force returning the Media toward the equilibrium position. This means that one would like the average pressure at "large paper to Platen spacing" to be comparable to the pressure of the negative supply. A simple equation for this is:

($P_{pos}$−Loss pl−Loss pq)=0 when the paper to platen spacing is 2 times the equilibrium spacing, $t_{equilibrium}$.

Nusselt Number Approximation:

Per the reference, "Heat and Mass Transfer", by Baehr, 2nd Edition, p 354, equation 3.258, the average Nusselt number is geometry dependent, and can be approximated by:

$$Nu=No*\tan h(2.432Pr^{1/6}X^{1/6}) \text{ where } X=(L/d\,Pe), \text{ and } No=3.65.$$

L is a characteristic length, and d is a characteristic thickness (Respectively b and t in this patent), and Pe is the Peclet number. Pr is the Prantl number, approximately 1; tan h is the hyperbolic tangent.

For this patent, this reduces to, as a function of geometric parameters:

$$Nu=0.136[M^4b^7\text{Pr}^2/\rho^4v^4A^4t^3)]^{1/6}$$

Where v=the kinematic viscosity.

Deflection Inequality:

It is desirable that the deflection of the Media not be large enough to contact the Platen.

Deflection of a Media can be approximated by plate clamped on all 4 edges, which equivalent to the boundary conditions in the middle of a large Media. From well-known shell deflection theory:

$$\varphi = \frac{Pb^4 * (0.00126) * 12(1 - v^2)}{E\delta^3};$$

Where $\phi$=the deflection v=the Poisson ratio $\delta$=the Media thickness

P=is a uniformly applied pressure

E=the Young's modulus of elasticity

We can require that $$\phi < 0.2t$$

The above equations and inequalities above may be used as constraints in a general purpose non-linear optimizer, such as the Nminimize function of Mathematica to minimize variables of interest—typically Platen area and power input—for a desired paper throughput. Thus, the optimizer is given the equations as constraints, and, say, Platen area to be optimized, and then chooses all the other design variables (within ranges) to optimize the Platen area. It should be recognized that all equations above are 1-dimensional equation approximations of 3 dimensional geometries, and as such, can be made more accurate by fluid flow simulations or experiment.

Figure 10A:
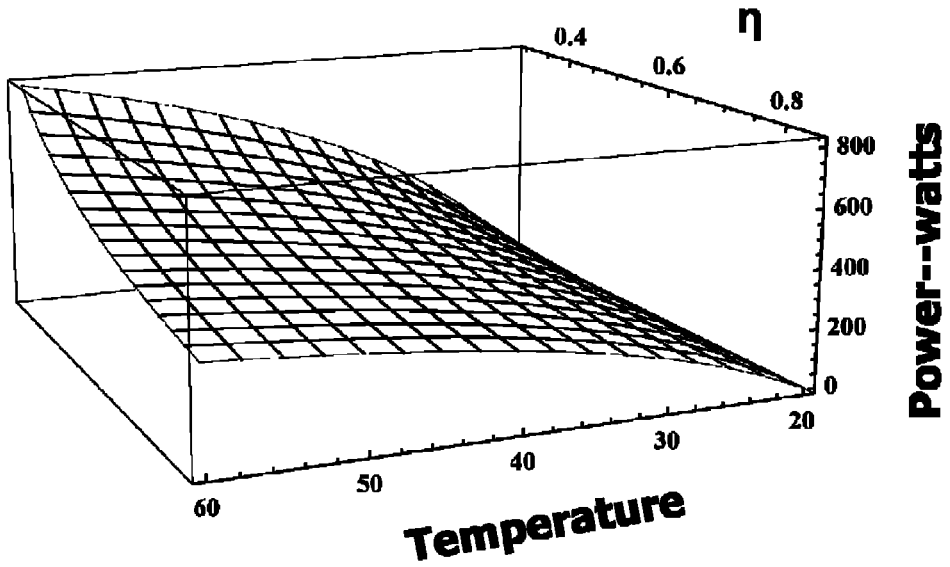
FIGS. 10*a* and 10*b* show alternative power and airflow requirements that enable drying of a sheet of fully printed paper to be dried at 30 pages per minute.
Figure 10B:
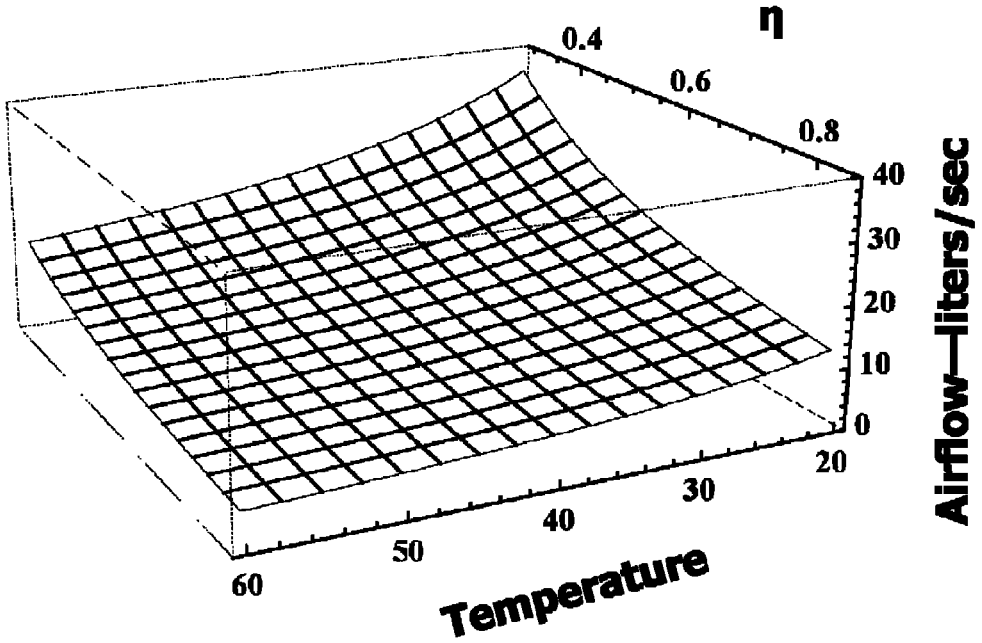

In FIGS. 10*a* and 10*b*, it is assumed that paper that is completely covered by 5 picoliter drops is being Dried in 2 seconds (30 pages per minute). FIG. 10*b* shows air flow rate M vs $T_{in}$, for various assumed heat exchange efficiencies, $\eta_{heat\ exchange}$. FIG. 10*a* shows a corresponding graph of the heated air power required, which is mathematically $(T_{in}-T_{ambient})*M*Cp_{air}$, for various heat exchange efficiencies. It is apparent that it is possible to evaporate all the water vapor with high enough air flows (20 liters per second) using no power to heat the air, or alternatively use up to 220 watts to heat air with about 5 liters per second airflow, when assuming that $\eta_{heat}$ exchange is 85%. Thus, fully saturated printed paper can be dried without input power by using about 20 liters per second ambient air, confined to the region between the Platen and the Media.

FIG. 12 shows a table of alternative design parameters for a Dryer capable of drying 30 "blacked out" pages per minute, using 5 picoliter drops at a 600 dpi pitch, in a 30% relative humidity environment, and resulting Platen area, power consumed, and paper to Platen spacing. The data in the table was developed using Mathematica's Nminimize function, minimizing the Platen area A, subject to the constraints above, and additional constraints on the minimum manufacturable inner radii of Orifices and spacing of Manifolds.

In the FIG. 12:

$T_{in}$=the Fluid temperature $P_{pos}$=the positive and negative supply pressures $T_{paper\ init}$=the paper temperature rm=the radius of the smallest part of the Manifold lp=the length of the constriction in the Manifold b=the spacing between Positive and Negative Pressure Orifice centers rp=the radius of the Positive Orifice rn=the radius of the Negative Orifice ln=the thickness of the Negative Orifice twall=the minimum feature thickness possible Nusselt=the computed Nusselt number Reynolds=the computed Reynolds number $\eta_{heat\ exchange}$=the computed heat exchange efficiency A=the area of the Platen Length=the length of the Platen t=the Media to Platen equilibrium separation M=the Fluid (air in this case) flow rate Pow-air=the power input into the air to reach $T_{in}$ Pow-pap=the power put into the paper prior to entry Power=the total power, the sum of Pow-air and Pow-pap From the table of FIG. 12, one can see (designs 1 through 19) that it is possible to Dry fully "blacked out" paper without a heater, thus consuming essentially no power. Alternatively, one could additionally employ either heated paper (designs 20-22), or heated air (designs 23-25), or both, allowing the use of a smaller Platen. Other designs could be done with larger spacings $t_{equilibrium}$ by not forcing area A to the smallest possible value. Design 2 has paper spacing ($t_{equilibrium}$) of 16 mils, consumes no power (other than the power to drive the fans), and requires a Platen length of 5.8 inches.

In some designs, such as design 15 of FIG. 12, the Platen is longer than the paper. In this case, the paper will still emerge from the Dryer at the required 30 pages per minute rate, though it will be under the Platen for more than 2 seconds. With Platens longer than the Media, it may be advantageous to have the Platen also in an arc shape to simultaneously redirect the Media while, in the case of inkjet Media, Drying. This is facilitated by the non-contact, frictionless forces provided by the Fluid that can force the Media to bend in conformity with the Platen shape.

The above specific solutions for inkjet printers are illustrative of relevant equations for other applications. For use of the concepts and designs presented in this invention in other applications, there will always be a pressure-flow equation, and a force balance equation, but other equations relating the diffusion related phenomena or other phenomena will depend on other process objectives.

In an alternative design, if the heat contained in the paper between the Fluid wet bulb temperature and the ambient is greater than the heat of vaporization of Fluid on a blacked out page (because the printer uses smaller drop volumes per pixel, or the paper is heavier weight, or the Fluid has a lower heat of vaporization), Drying would be limited by only mass diffusion, which is significantly faster than heat diffusion. The required Fluid flow rate would be limited by that required to keep the Fluid from being saturated with water vapor, and maintaining the necessary vapor gradients. The simulation equations above would be the same equations, but the mass transfer efficiency air flow equation would be the limiter, not the heat transfer efficiency-air flow equation. One could design using the same procedure outlined above a high efficiency mass flow transfer apparatus with efficiencies of over 80%. Then, if a page had 0.05 cc of Fluid on it (roughly ⅓ of that assumed in the simulations above, and ⅓ the current practice), one would only require that the air passing through the Platen could absorb 0.05 cc/0.8=0.0625 cc Fluid without saturating. For 30% humidity air, the amount of additional Fluid that can be added to air before saturation is 0.012 grams of Fluid per gram of air. Thus removing the Fluid from a page with 0.05 cc ink would require 0.0625/0.012=5 grams of air per page. At thirty pages per minute, this is 2.5 grams of air per second, or about 2.3 liters per second—considerably lower than the 18 liters per second required when ambient air is used to supply heat to the paper (see FIG. 10*b* at 20 degrees C. and 85% efficiency). In this case, the Platen length can be decreased to a few centimeters, the paper to Platen spacing can be increased, the fan size would be modest, the air ducting would be compact, and the system would require no heat.

Thus there is considerable incentive to reduce the amount of ink on the page.

One method of reducing the amount of ink on a page is described by U.S. Pat. No. 6,155,670, by this inventor and others, and assigned to Hewlett Packard Co.

Another way to reduce the heat of vaporization required is to use organic solvents, which have lower heat of vaporization. However, the use of volatile organics have potential negative environmental problems, and may result in rapid clogging of a printhead.

Alternatively, Media that allow a certain amount of ink Fluid to remain on the page without cockle or smear, such as coated Media, reduce Drying requirements and make possible smaller Platen sizes, lower airflow rates, and decrease or eliminate the need for additional heat. However, coated Media is not favorably received by the public for everyday use because it is expensive and not widely available, so it cannot be viewed as a generally useful solution to the Drying problem.

Returning to the conditions where the printer ejects 5 picoliter drops on a 600 dpi pitch, and 4 mil thick paper, in design 25, the Fluid (air) is supplied at 27 degrees C. (i.e., slightly above room temperature) and about 14 liters per second; the resulting power consumption is about 121 watts. However, typical pages have less than 10% density ink coverage. Thus the warmed air can be recycled so the heater has to supply only fraction of the peak heat requirement on average. With little ink on the paper, power is still used to heat the paper from 20 to 27 degrees C. (with 85% efficiency), consuming about 45 joules of what would have been over 242 joules had the paper been covered in ink. However, the remaining energy can be recycled, resulting in about 70% energy saving. Thus, the average power required to Dry paper with on average 10% printing density using 27 degrees C. heated air would be about 36 watts if the Fluid (air) is recycled.

FIG. 9*a* shows schematically a non-recycled supply scheme with Platen 160 fed by positive Plenum 167, and exhausted by negative Plenum 161 by blowers 164 and 163, with arrows showing direction of Fluid flow. Pump 164 receives Fluid from reservoir (which, in the case of an inkjet printer, could be the environment) 169 via conduit 168. Pump 162 exhausts the Plenum via 161 through conduit 166 to a reservoir, or sump (in the case of an inkjet printer, the environment).

A recycling scheme is indicated schematically in FIGS. 9*b* and 9*c*. In FIG. 9*b*, a single fan recirculates substantially all the air. Air is exhausted from Platen 160 by conduit 170 through pump 172, where it is pumped through conduit 171 back to the Platen. This might be a suitable scheme where there were no undesirable reaction products or consumption of the Fluid or its constituents. One example is the case of a Fluid that acts as a catalyst.

In FIG. 9*c*, a fan 184 drives recirculated air from path 180 as well as room air entering from port 188 and resistive flow path 182 through path 186 to the positive Manifold 33. The flow resistances 189 and 182, which can be varied through the use of some form of controller, determine the mixing ratios of recycled air to ambient air. There are many other schemes that vary the amount of recycled air to ambient air presented at the positive Manifold 33 as would be well known to anyone skilled in the art.

The fraction of air (more generally, Fluid) that is recycled may be held constant, or varied by a controller, as determined by the amount of ink on previous pages, and the thermal mass and other characteristics of the heater, or by measurements of such parameters as the exiting Fluid temperature, or concentration of Reactants in the exiting Fluid. The thermal mass of the heater (such as 80 in FIG. 4) may be made large enough so that it would not decrease its temperature significantly when loaded with cool air exiting from, for example, 10 blacked out pages.

Since Media 5 is supported by the current designs without contact with a surface Media 5 can be Dried or Conditioned simultaneously on both sides—enabling simultaneous double sided printing—heretofore not possible in low cost inkjet printers.

Compared to prior inkjet art, printers incorporating the current designs enable much faster printing, enable double sided print, and result in more vibrant and sharp print, and more permanent print, at a very small increase in cost over the current state of the art printers.

Similar corresponding benefits are available in other diffusion limited processes involving surfaces, such as the plating example mentioned above.

An other advantage of the current designs is that the apparatus can force Media 5 to conform to a flat shaped Platen 4 thus maintaining an arbitrarily large flat zone. This in turn, allows the use of print heads larger than the current state of the art, ⅝th inch swath can be used, thus increasing the print rate correspondingly.

While the features disclosed herein have been described with respect to various designs and focused more on inkjet printing, there are other designs which could be implemented to utilize those disclosed features and many other applications for other types of Media whether they be fabric, sheet materials such as plastic and rubber and metals such as aluminum and steel, and even semiconductor materials to name just a few. Clearly one skilled in various arts could foresee many different applications to many different materials that are similar and equivalent to what has been discussed here.

What is claimed is:

1. An apparatus for processing a media itself, or an applied material selectively deposited on a media surface, said apparatus to condition said media or applied material as said media is advanced through said apparatus, or in proximity to, said apparatus comprising:

a delivery system for advancing said media;

a fluid;

a platen, as portions of said media exit said delivery assembly, is disposed to be adjacent to, and spaced apart from, said portions of said media surface, wherein said platen having defined therethrough a plurality of spaced apart orifices that are substantially alternatingly positively and negatively pressurized to a direct fluid toward and to withdraw said fluid from, respectively, a region between said platen and said media surface optionally having said applied material thereon, with the equilibrium separation of the media from the platen established by the geometry of the orifices and manifolds, and pressures supplied to the manifolds; and a fluid pressure source coupled to said platen to apply said fluid having a selected positive gauge pressure to said positively pressurized orifices and to apply a selected negative gauge pressure to said negatively pressurized orifices to withdraw said fluid therefrom;

wherein said applied material on said media surface, or the media itself, is conditioned by said fluid between said platen and said media surface and wherein said platen has a selected contour or shape with the net pressure between said platen and said media surface when not at an equilibrium spacing $t_{equilibrium}$ causing said portion of the media to substantially take said contour or shape when adjacent said platen.

2. The apparatus as in claim 1 further comprising a heater to heat the fluid emitted by said positively pressurized orifices of said platen.

3. The apparatus as in claim 2 wherein said heater is disposed between said fluid pressure source and the positively pressurized orifices of said platen.

4. The apparatus as in claim 1 wherein said platen incorporates radiation, or electric, or magnetic, or electromagnetic field emitting devices with radiation or electromagnetic field directed to the media.

5. The apparatus in claim 1 further includes a branched manifold contained within a plenum of the opposite pressure, reducing the pressure drop throughout said plenum, and the pressure drop throughout the branched manifold to a negligible fraction of the total pressuer drop supplied by said fluid pressure source.

6. The apparatus of claim 1 wherein the media is preheated before reaching the platen.

7. An inkjet printer comprising an apparatus for processing a media itself, or an applied material selectively deposited on a media surface to condition said media or applied material as said media is advanced through the apparatus, said apparatus comprising:

a delivery system for advancing said media;

a fluid delivery system;

a platen, as portions of said media exit said delivery assembly, is disposed to be adjacent to, and spaced apart from, said portions of said media surface, wherein said platen has defined therethrough a plurality of spaced apart orifices that are substantially alternatingly positively and negatively pressurized to a direct said fluid toward and to withdraw said fluid from, respectively, a region apart from said platen adjacent said media surface optionally having said applied material thereon, with the equilibrium separation of the media from the platen established by the geometry of the orifices and manifolds, and pressures supplied to the manifolds; and a fluid pressure source coupled to said platen to apply said fluid having a selected positive gauge pressure to said positively pressurized orifices and to apply a selected negative gauge pressure to said negatively pressurized orifices to withdraw said fluid therefrom;

wherein said platen has a selected contour or shape with the net pressure between said platen and said media surface when not at an equilibrium spacing $t_{equilibrium}$ causing said portion of the media to substantially take said contour or shape when adjacent said platen.

8. The apparatus as in claim 7 wherein said applied material on said media surface, or the media itself, is conditioned by said fluid between said platen and said media surface.

9. The apparatus as in claim 7 further comprising a heater to heat the fluid emitted by said positively pressurized orifices of said platen.

10. The apparatus as in claim 9 wherein said heater is coupled between said fluid pressure source and said positively pressurized orifices of said platen.

11. The apparatus as in claim 7 wherein said platen incorporates radiation, or electric, or magnetic, or electromagnetic field emitting devices with radiation or electromagnetic field directed to the media.

12. The apparatus as in claim 7 wherein said fluid pressure source is a single fluid pressure source to capture fluid from a negative pressure pump and recirculate said fluid to a positive pressure pump.

13. The apparatus as in claim 7 further includes a branched manifold contained within a plenum of the opposite pressure, reducing the pressure drop throughout said plenum, and the pressure drop throughout the branched manifold to a negligible fraction of the total pressuer drop supplied by said fluid pressure source.

14. The apparatus of claim 7 wherein the media is preheated before reaching the platen.

15. An apparatus for processing a media itself, or an applied material selectively deposited on a media surface, said apparatus to condition said media or applied material as said media is advanced through said apparatus, or in proximity to, said apparatus comprising:

a delivery system for advancing said media;

a fluid;

a platen, as portions of said media exit said delivery assembly, is disposed to be adjacent to, and spaced apart from, said portions of said media surface, wherein said platen having defined therethrough a plurality of spaced apart orifices that are substantially alternatingly positively and negatively pressurized to a direct fluid toward and to withdraw said fluid from, respectively, a region between said platen and said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

a source of an additional applied material; and a dispensing device coupled to said fluid pressure source or between said fluid pressure source and said positively pressurized orifices of said platen, to selectively add said additional applied material to said fluid.

16. An apparatus for processing a media itself, or an applied material selectively deposited on a media surface, said apparatus to condition said media or applied material as said media is advanced through said apparatus, or in proximity to, said apparatus comprising:

a delivery system for advancing said media;

a fluid;

a platen, as portions of said media exit said delivery assembly, is disposed to be adjacent to, and spaced apart from, said portions of said media surface, wherein said platen having defined therethrough a plurality of spaced apart orifices that are substantially alternatingly positively and negatively pressurized to a direct fluid toward and to withdraw said fluid from, respectively, a region between said platen and said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

a source of reactant; and a dispensing device coupled to said fluid pressure source or between said fluid pressure source and positively pressurized orifices of said platen, to selectively add said reactant to said fluid.

17. An apparatus for processing a media itself, or an applied material selectively deposited on a media surface, said apparatus to condition said media or applied material as said media is advanced through said apparatus, or in proximity to, said apparatus comprising:

a delivery system for advancing said media;

a fluid;

a platen, as portions of said media exit said delivery assembly, is disposed to be adjacent to, and spaced apart from, said portions of said media surface, wherein said platen having defined therethrough a plurality of spaced apart orifices that are substantially alternatingly positively and negatively pressurized to a direct fluid toward and to withdraw said fluid from, respectively, a region between said platen and said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

wherein said applied material on said media surface, or the media itself, is conditioned by said fluid between said platen and said media surface and wherein said fluid pressure source is a single fluid pressure source to capture fluid from a negative pressure pump and recirculate said fluid to a positive pressure pump .

18. The apparatus as in claim 17 further includes a variable resistive conduit connected across said single fluid pressure source to selectively shunt additional fluid from said negative pressure pump and said positive pressure pump.

19. An inkjet printer comprising an apparatus for processing a media itself, or an applied material selectively deposited on a media surface to condition said media or applied material as said media is advanced through the apparatus, said apparatus comprising:

a delivery system for advancing said media;

a fluid delivery system;

a platen, as portions of said media exit said delivery assembly, is disposed to be adjacent to, and spaced apart from, said portions of said media surface, wherein said platen has defined therethrough a plurality of spaced apart orifices that are substantially alternatingly positively and negatively pressurized to a direct said fluid toward and to withdraw said fluid from, respectively, a region apart from said platen adjacent said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

a source of an additional applied material; and a dispensing device coupled to said fluid pressure source or between said fluid pressure source and said positively pressurized orifices of said platen, to selectively add said additional applied material to said fluid.

20. An inkjet printer comprising an apparatus for processing a media itself, or an applied material selectively deposited on a media surface to condition said media or applied material as said media is advanced through the apparatus, said apparatus comprising:

a delivery system for advancing said media;

a fluid delivery system;

a platen, as portions of said media exit said delivery assembly, is disposed to be adjacent to, and spaced apart from, said portions of said media surface, wherein said platen has defined therethrough a plurality of spaced apart orifices that are substantially alternatingly positively and negatively pressurized to a direct said fluid toward and to withdraw said fluid from, respectively, a region apart from said platen adjacent said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

a source of reactant; and a dispensing device coupled to said fluid pressure source or between said fluid pressure source and said positively pressurized orifices of said platen, to selectively add said reactant to said fluid.

21. An inkjet printer comprising an apparatus for processing a media itself, or an applied material selectively deposited on a media surface to condition said media or applied material as said media is advanced through the apparatus, said apparatus comprising:

a delivery system for advancing said media;

a fluid delivery system;

a platen, as portions of said media exit said delivery assembly, is disposed to be adjacent to, and spaced apart from, said portions of said media surface, wherein said platen has defined therethrough a plurality of spaced apart orifices that are substantially alternatingly positively and negatively pressurized to a direct said fluid toward and to withdraw said fluid from, respectively, a region apart from said platen adjacent said media surface optionally having said applied material thereon, with the equilibrium separation of the media from the platen established by the geometry of the orifices and manifolds, and pressures supplied to the manifolds;

a fluid pressure source coupled to said platen to apply said fluid having a selected positive gauge pressure to said positively pressurized orifices and to apply a selected negative gauge pressure to said negatively pressurized orifices to withdraw said fluid therefrom;

wherein said applied material on said media surface, or the media itself, is conditioned by said fluid between said platen and said media surface; and wherein said fluid pressure source is a single fluid pressure source to capture fluid from a negative pressure pump and recirculate said fluid to a positive pressure pump.

22. The apparatus as in claim 21 further includes a variable resistive conduit connected across said single fluid pressure source to selectively shunt additional fluid from said negative pressure pump and said positive pressure pump.

* * * * *